US007922317B2

(12) United States Patent
Nakazawa et al.

(10) Patent No.: US 7,922,317 B2
(45) Date of Patent: Apr. 12, 2011

(54) INK JET PRINTING APPARATUS, DATA GENERATION APPARATUS AND PRINTED PRODUCT

(75) Inventors: Koichiro Nakazawa, Machida (JP); Takuei Ishikawa, Tokyo (JP); Hideaki Takamiya, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 914 days.

(21) Appl. No.: 11/762,951

(22) Filed: Jun. 14, 2007

(65) Prior Publication Data

US 2007/0291071 A1 Dec. 20, 2007

(30) Foreign Application Priority Data

Jun. 14, 2006 (JP) ..... 2006-165192
Apr. 9, 2007 (JP) ..... 2007-101615

(51) Int. Cl.
*B41J 2/015* (2006.01)

(52) U.S. Cl. ..... 347/101; 347/21

(58) Field of Classification Search ..... 347/21, 347/95, 96, 100–104
See application file for complete search history.

(56) References Cited

U.S. PATENT DOCUMENTS

| | | | | |
|---|---|---|---|---|
| 5,356,464 | A | 10/1994 | Hickman et al. | 106/20 R |
| 5,579,693 | A | 12/1996 | Carreira et al. | 101/424.1 |
| 5,734,403 | A | 3/1998 | Suga et al. | 347/101 |
| 5,764,263 | A * | 6/1998 | Lin | 347/101 |
| 6,162,510 | A | 12/2000 | Kashiwazaki et al. | 427/511 |
| 6,203,604 | B1 | 3/2001 | Kashiwazaki et al. | 106/31.5 |
| 6,248,482 | B1 | 6/2001 | Kashiwazaki et al. | 430/7 |
| 6,659,601 | B2 | 12/2003 | Goto et al. | 347/100 |
| 6,729,718 | B2 | 5/2004 | Goto et al. | 347/100 |
| 6,833,158 | B2 | 12/2004 | Suzuki et al. | 427/149 |
| 7,008,671 | B2 | 3/2006 | Ishikawa et al. | 427/152 |
| 7,048,356 | B2 * | 5/2006 | Ishikawa et al. | 347/41 |
| 7,211,120 | B2 | 5/2007 | Ishikawa et al. | 8/478 |
| 7,297,365 | B2 | 11/2007 | Ishikawa et al. | 427/152 |
| 7,311,394 | B2 * | 12/2007 | Ishikawa et al. | 347/101 |
| 7,510,253 | B2 * | 3/2009 | Tatsumi | 347/14 |
| 2006/0109322 | A1 | 5/2006 | Nakazawa et al. | 347/95 |
| 2006/0109326 | A1 | 5/2006 | Nakazawa et al. | 347/101 |
| 2006/0194056 | A1 | 8/2006 | Nagashima et al. | 428/403 |
| 2006/0194897 | A1 | 8/2006 | Kawabe et al. | 523/160 |
| 2006/0203029 | A1 * | 9/2006 | Nishida et al. | 347/21 |
| 2006/0269876 | A1 | 11/2006 | Ishikawa et al. | 430/312 |
| 2007/0093386 | A1 | 4/2007 | Ishikawa et al. | 503/227 |

FOREIGN PATENT DOCUMENTS

| | | |
|---|---|---|
| JP | 3-240557 | 10/1991 |
| JP | 3-240558 | 10/1991 |
| JP | 5-202328 | 8/1993 |
| JP | 6-106735 | 4/1994 |
| JP | 6-157955 | 6/1994 |
| JP | 8-216384 | 8/1996 |

* cited by examiner

*Primary Examiner* — Daniel Petkovsek
(74) *Attorney, Agent, or Firm* — Fitzpatrick, Cella, Harper & Scinto

(57) ABSTRACT

Without newly providing a curling inhibition apparatus or a curling inhibitor and without placing excessive restrictions on a composition of an ink or a printing properties enhancing liquid, curling after printing is suppressed. In an ink jet printing apparatus which performs printing on a printing medium by ejecting from a printing head an ink and a reaction liquid which reacts with the ink, said apparatus comprising; means for on the basis of ink ejection data for ejecting the ink onto an one side of the printing medium, generating reaction liquid ejection data for ejecting the reaction liquid onto an other side of the printing medium.

8 Claims, 12 Drawing Sheets

INK JET PRINTING APPARATUS, DATA GENERATION APPARATUS AND PRINTED PRODUCT

BACKGROUND OF THE INVENTION

1. Field of the Invention

The present invention relates to an ink jet printing apparatus, a data generation apparatus and a printed product. In particular, the present invention relates to an ink jet printing apparatus using printing properties enhancing liquid and colored inks, a data generation apparatus and a printed product.

2. Description of the Related Art

An ink jet printing method is a printing method for printing by causing small droplets of ink to splash and adhere to a printing medium such as paper. For this reason, when the ink adheres to the printing medium, a contour part may become unclear due to permeation of ink droplets into the printing medium particularly in the case where a printing medium such as plain paper is used. Moreover, a phenomenon of blurring on a boundary between different colors adjacent to each other (so-called color bleeding) may occur.

Against this background, there has been disclosed a method for applying an ink containing a dye having at least one carboxyl group after application of a solution containing polyvalent metal salt to a printing medium as the art of reducing color breeding by Japanese Patent Laid-Open No. Hei 5 (1993)-202328. Specifically, a solution (printing properties enhancing liquid) containing polyvalent metal ions and an ink containing a dye that can react with the ion come into contact with each other on a printing medium to form an insoluble substance. As a result, unclarity in the contour part is eliminated, and color bleeding is reduced. Furthermore, it is possible to obtain high-quality images in which going-through of a color material to a back surface of the printing medium is reduced (hereinafter also referred to as going-through resistance).

Moreover, there has been disclosed a technique of obtaining high-quality color images having high image density without color bleeding by using a combination of a black ink to be viscous or coagulated by reaction with salt and a color ink containing the salt by Japanese Patent Laid-Open No. Hei 6 (1994)-106735. In the above technique, two liquids which react with each other when mixed together are used as a set, and an image is formed on a printing medium by using such two liquids having different properties in image formation. Accordingly, clear images are obtained (an ink set using approximately achromatic liquids regardless of reaction will be hereinafter called a two-part liquid system). Besides the above, various techniques using two liquids have been disclosed by Japanese Patent Laid-Open Nos. Hei 3 (1991)-240557 and Hei 3 (1991)-240558.

With the two-part liquid system using such an ink set, unclarity in a contour part is eliminated. Moreover, in the case where a plurality of different color inks are used, high-quality images having excellent going-through resistance without color bleeding can be formed.

Specifically, in an image formation method using the two-part liquid system, polyvalent metal ions in a printing properties enhancing liquid react with a color material in an ink. For example, when the color material is a dye, the dye is coagulated. Moreover, when the color material is a pigment, the pigment is dispersed and destroyed. As a result, it is possible to achieve effects of eliminating unclarity in the contour part and of suppressing occurrence of color bleeding.

However, when the two-in-one liquid system is used, it is required to allow the two liquids, the printing properties enhancing liquid and the ink, to come into contact and react with each other on or in the printing medium. Thus, an amount of the liquids applied onto the printing medium may be increased compared with the case of a one-in-one liquid system using only an ink for image formation. As a result, in the case of the two-in-one liquid system, occurrence frequency of curling of printed paper is increased, and the curling occurs more frequency than in the case of the one-in-one liquid system.

To solve this problem, there has been disclosed a technique of suppressing curling by adding a heretofore known curling inhibitor to an ink by Japanese Patent Laid-Open No. Hei 6 (1994)-157955. For details, 1,3-diols, 1,3,5-triols, amino-1, 3-diols or the like is added as the curling inhibitor into the ink. The above method can suppress occurrence of curling. However, a large amount of the curling inhibitor has to be added into the ink. This may result in deterioration in image quality of images to be obtained, the clogging of nozzles, apparatus reliability and the like.

As an alternative for the above configuration, there has been disclosed a method for applying a curling inhibitor for reducing curling onto a back surface of printing paper by use of a coating roller (Japanese Patent Application Laid-Open Publication No. Hei 8 (1996)-216384). The above document also discloses selective application of the curling inhibitor by use of a liquid ejection head having the width of a printing medium. To be more specific, this document discloses the application of the curling inhibitor by selecting its application region corresponding to an ink application region on a front surface.

However, in the method disclosed in JPA 8-216384 for applying the curling inhibitor for reducing curling onto the back surface of the printing paper by use of the coating roller, there arises a need to provide the curling inhibitor liquid and the coating roller only for suppression of curling. Moreover, consumption of the curling inhibitor liquid may be increased by application on the entire surface of a printing medium, and an apparatus size may be increased by providing the coating roller.

Meanwhile, by using the ejection head having the width of the printing medium to selectively apply the curling inhibitor liquid, the consumption of the curling inhibitor liquid can be suppressed. However, even in a configuration using an ejection head for the curling inhibitor liquid, a dedicated part for suppression of curling is to be provided after all. Thus, problems such as increases in the apparatus size and in cost still remain unsolved.

SUMMARY OF THE INVENTION

The present invention was made in consideration of the circumstances described above. It is an object of the present invention to provide an ink jet printing apparatus capable of high-quality image printing while reducing curling of a printing medium without an exclusive curling inhibition part, and to provide a data generation apparatus and a printed product.

An ink jet printing apparatus of the present invention for achieving the above object performs printing on a printing medium by ejecting from a printing head an ink and a reaction liquid which reacts with the ink, said apparatus comprising; means for on the basis of ink ejection data for ejecting the ink onto an one side of the printing medium, generating reaction liquid ejection data for ejecting the reaction liquid onto an other side of the printing medium.

The above configuration enables ejection of the reaction liquid onto a back of a printed image. As a result, curling of the printing medium can be suppressed without providing an exclusive curling inhibition apparatus.

Further features of the present invention will become apparent from the following description of exemplary embodiments (with reference to the attached drawings).

DESCRIPTION OF THE EMBODIMENTS

With reference to the drawings, embodiments of the present invention will be described in detail below.

First Embodiment

1. Basic Configuration 1.1 Configuration of Mechanical Part

Figure 1:
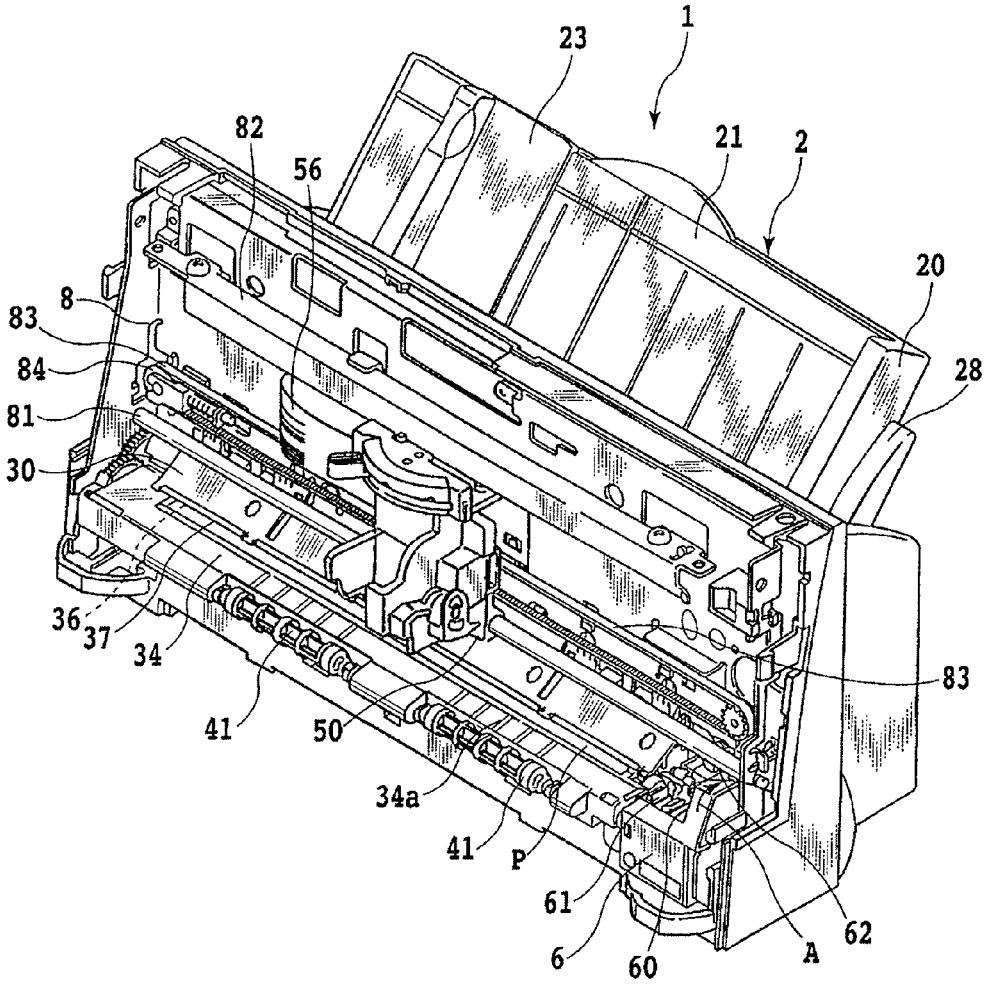
FIG. 1 is a perspective view showing an entire configuration of an ink jet printing apparatus according to a first embodiment of the present invention.

FIG. 1 is a perspective view showing an entire configuration of an ink jet printing apparatus applied in a first embodiment of the present invention.

Figure 2:
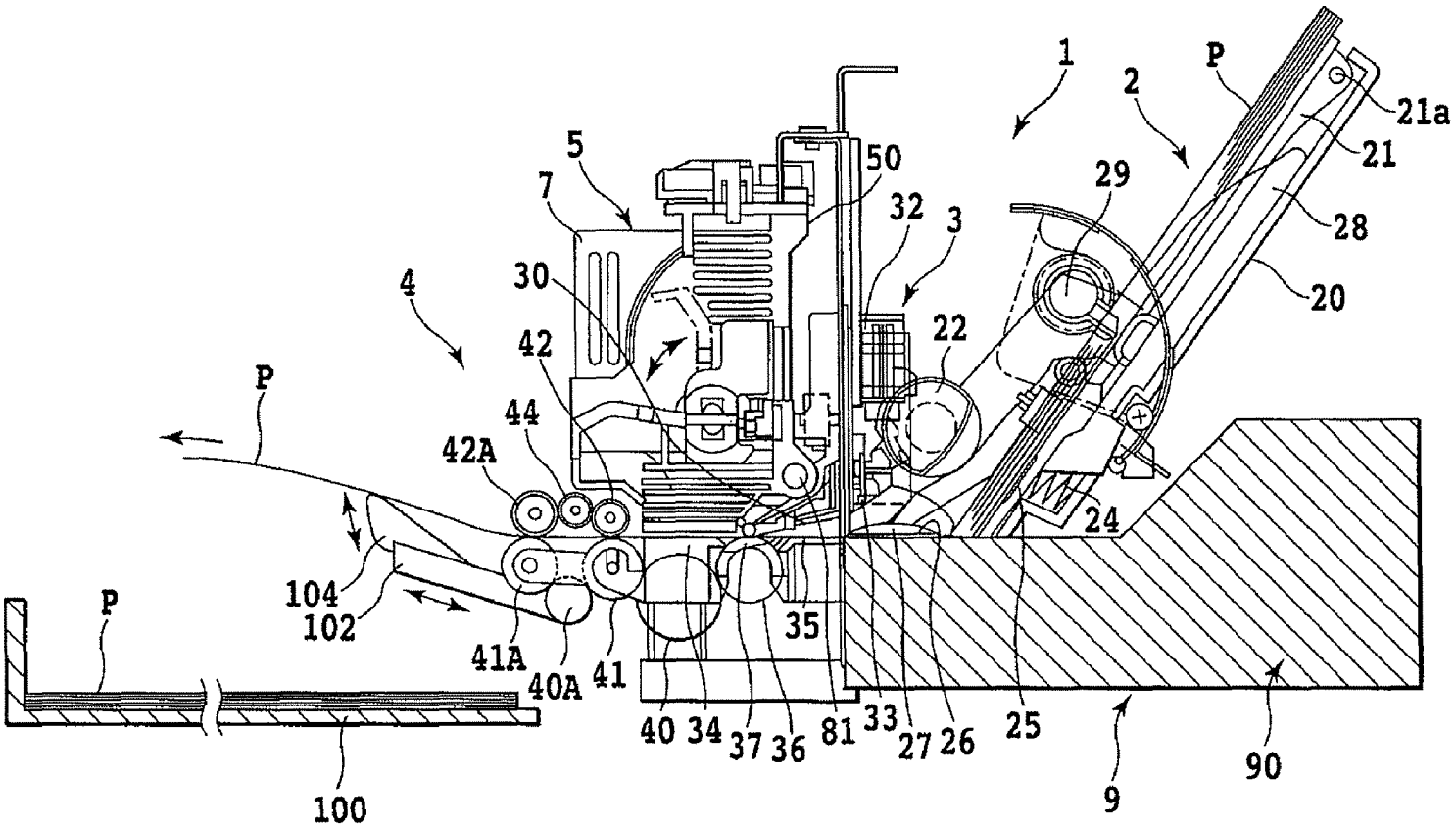
FIG. 2 is a side cross-sectional view of the ink jet printing apparatus according to the first embodiment of the present invention.

FIG. 2 is a side cross-sectional view showing the configuration of the ink jet printing apparatus applied in the first embodiment of the present invention.

An ink jet printing apparatus 1 mainly includes a paper feeding section 2, a paper conveying section 3, a paper discharging section 4, a carriage section 5 and a cleaning section 6. Moreover, in this embodiment, the apparatus is configured to enable printing on both sides of a printing medium, and includes a printing medium inverting section 9.

(A) Paper Feeding Section

In the paper feeding section 2, a pressure plate 21 loaded with printing media P and a feeding rotor 22 for feeding the printing media P are attached to a base 20. A movable side guide 23 is movably provided on the pressure plate 21, and the movable side guide 23 controls the loading position of the printing media P. The pressure plate 21 can be rotated around a rotation axis 21*a* connected to the base 20 and is energized toward the feeding rotor 22 by a pressure plate spring 24. In a portion of the pressure plate 21 facing the feeding rotor 22, a separation pad 25 made of a material having a large friction coefficient, such as s leather, is provided in order to prevent the printing media P from being fed in piles. Furthermore, the base 20 has a separation claw 26 for separating the printing media P from each other while covering a corner portion in one direction of the printing media P. At a plain paper position, the separation claw 26 is operated, and a release cam 29 for releasing contact between the pressure plate 21 and the feeding rotor 22 is provided. Moreover, a bank part 27 formed integrally with the base 20 is provided to separate sheets from each other when the printing media P are heavy paper or the like, where the separation claw 26 cannot be used. At a heavy paper position, a switching lever 28 is provided for switching so as to inhibit the operation of the separation claw 26.

In the above configuration, the release cam 29 pushes the pressure plate 21 down to a predetermined position in a standby state. Thus, contact is released between the printing media P stacked on the pressure plate 21 and the feeding rotor 22. When, in this state, a driving force of a conveying roller 36 is transmitted to the feeding rotor 22 and the release cam 29 by gears and the like, the release cam 29 is separated from the pressure plate 21. Thereafter, the pressure plate 21 is lifted, and the feeding rotor 22 and the printing media P come into contact with each other. Subsequently, the printing media P are picked up and start to be fed along with rotation of the feeding rotor 22. Accordingly, the printing media P are sent to the paper conveying section 3 while being separated from each other by the separation claw 26. The feeding rotor 22 and the release cam 29 are rotated until the printing medium P is sent to the paper conveying section 3. When sending of the printing medium P to the paper conveying section 3 is finished, the contact between the printing media P and the feeding rotor 22 is released again by the release cam 29 and the standby state is set. Accordingly, the driving force of the conveying roller 36 is shut off.

(B) Paper Conveying Section

The paper conveying section 3 has the conveying roller 36 for conveying the printing media P and a PE sensor 32. In the conveying roller 36, a pinch roller 37 rotated while following the conveying roller 36 is provided.

The pinch roller 37 is rotatably held by a pinch roller guide 30. The pinch roller guide 30 is energized by a pinch roller spring 31 to press the pinch roller 37 against the conveying roller 36. Accordingly, force for conveying the printing media P is generated. Furthermore, at the entrance of the paper conveying section 3, through which each of the printing media P is conveyed, an upper guide 33 for guiding the printing medium P and a platen 34 are provided. Moreover, in the upper guide 33, a PE sensor lever 35 is provided, which transmits detection of front and rear ends of the printing medium P to the paper end sensor (PE sensor) 32.

In the above configuration, the printing medium P sent to the paper conveying section 3 is guided by the platen 34, the pinch roller guide 30 and the upper guide 33 and sent to the pair of rollers including the conveying roller 36 and the pinch roller 37. In this event, the PE sensor lever 35 is pushed and rotated by the front end of the printing medium P, and the PE sensor 32 detects the rotation. Based on the detection signal from the PE sensor 32, a later-described controller obtains a printing position of the printing medium P. Moreover, the printing medium P is conveyed on the platen 34 by rotating the pair of rollers 36 and 37 by use of a conveying motor (not shown).

Note that a printing head 7 is replaceably mounted on a later-described carriage 50 and is configured to detachably hold an ink tank. Moreover, a plurality of nozzles are arranged in the printing head 7, and electrothermal converting elements, such as heaters, are provided in each of the nozzles. The electrothermal converting elements are driven to apply heat to ink, which heat causes film boiling in the ink. Moreover, by a pressure change caused by growth or shrinkage of bubbles in the film boiling, the ink is ejected from the nozzles to form an image on the printing medium P.

(C) Paper Discharging Section

In the paper discharging section 4, two paper discharging rollers 41 and 41A are provided in parallel at different positions in the sub scanning direction. Moreover, a transmission roller 40 abutting on the conveying roller 36 and the paper discharging roller 41 and a transmission roller 40A abutting on the paper discharging rollers 41 and 41A are provided. A rotary driving force of the conveying roller 36 is transmitted to the paper discharging roller 41 through the transmission roller 40, and the rotary driving force is further transmitted to the paper discharging roller 41A through the transmission roller 40A.

Moreover, spurs 42 and 42A abut on the paper discharging rollers 41 and 41A, respectively, so as to be rotated while following the paper discharging rollers 41 and 41A. Furthermore, a cleaning roller 44 rotatably abuts on the spurs 42 and 42A.

By use of the above configuration, the printing medium P having an image formed thereon by the carriage section 5 is sandwiched by the paper discharging rollers 41 and 41A and the spurs 42 and 42A, conveyed by rotations of the rollers, and discharged onto a paper discharging tray 100.

On a downstream side of the paper discharging roller 41A, a later-described paper discharging support 104 is provided to support the printing medium P discharged after printing. The paper discharging support 104 is rotatably attached to a guide member 102. The guide member 102 is supported so as to be linearly movable between a projected position from the platen 34 and a retracted position onto the platen 34. Along with movement of the guide member 102, the paper discharging support 104 is rotated. Note that a route of conveying the printing medium from the paper feeding section 2 through the printing head 7 to the paper discharging support 104 forms a first conveying route.

(D) Carriage Section

The carriage section 5 includes the carriage 50 on which the printing head 7 is replaceably mounted. The carriage 50 is supported so as to be movable in a main scanning direction perpendicular to a direction of conveying the printing medium P (the sub scanning direction) by a guide shaft 81 extended in the main scanning direction and a guide rail 82 which maintains a space between the printing head 7 and the printing medium P. Note that the guide shaft 81 and the guide rail 82 are attached to a chassis 8. Moreover, the carriage 50 is driven via a timing belt 83 by a carriage motor (not shown) attached to the chassis 8. The timing belt 83 is supported while maintaining a proper degree of tension between idle pulleys 84. Furthermore, a flexible substrate 56 for transmitting a head drive signal from an electric substrate 9 to the printing head 7 is connected to the carriage 50.

In the above configuration, when an image is formed on the printing medium P, the printing medium P is conveyed in the sub-scanning direction by rotation of the pair of rollers 36 and 37, and the printing medium P is moved to a printing position on the platen 34. Moreover, the carriage 50 is driven by a carriage motor 80 to move the printing head 7 to an image formation position on the printing medium P in the main scanning direction. Thereafter, according to a printing start command, the carriage 50 is moved in the main scanning direction. At the same time, in response to a signal from the electric substrate 9, the ink is ejected from the printing head 7 onto the printing medium P to form an image.

Moreover, attachment/detachment of the printing head 7 to/from the carriage 50 and attachment/detachment of the ink tank to/from the printing head 7 are performed at a predetermined replacement position after the carriage 50 is moved to the replacement position by pressing an operation key (not shown).

(E) Cleaning Section

The cleaning section 6 includes: a pump 60 for cleaning the printing head 7; a cap 61 for keeping the printing head 7 from drying; and a drive switching arm 62 for switching the rotary driving force of the conveying roller 36 between the paper feeding section 2 and the pump 60. Apart from the time of paper feeding or cleaning, the drive switching arm 62 fixes a planetary gear (not shown), which is rotated around a shaft center of the conveying roller 36, at a predetermined position. Thus, no driving force is transmitted to the paper feeding section 2 and the pump 60. By the movement of the carriage 50, the drive switching arm 62 is moved in a direction indicated by an arrow A in FIG. 1, and the planetary gear is set free. Therefore, the planetary gear is moved according to normal rotation and reverse rotation of the conveying roller 36. Specifically, the driving force is transmitted to the paper feeding section 2 when the conveying roller 36 is normally rotated, and is transmitted to the pump 60 when the conveying roller 36 is reversely rotated.

(F) Recording Medium Inverting Section

Figure 3:
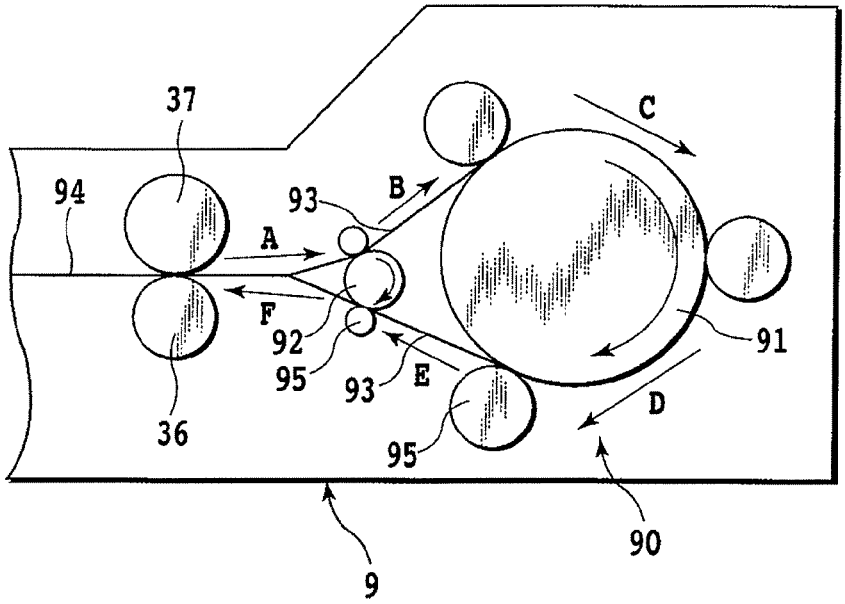
FIG. 3 is an explanatory side view showing a schematic configuration of a printing medium inverting section according to the first embodiment of the present invention.

FIG. 3 is a simplified view showing a printing medium inverting section including an inversion unit according to the first embodiment of the present invention.

The printing medium inverting section 9 includes: a paper feeding conveying route 94 continuous with the first conveying route; and an inversion unit 90 positioned on the back side (right side in FIG. 2) of the conveying roller 36 and the ink jet printing apparatus 1. The inversion unit 90 includes a paper holding roller 95, a small inversion roller 92, a looped inversion conveying route 93 and a large inversion roller 91. The conveying roller 36 can be rotary driven normally and reversely by the motor. Note that the paper feeding conveying route 94 and the inversion conveying route 93 form a second conveying route. Moreover, the inversion unit 90 is configured to be attachable to the printing apparatus.

In automatic double-sided printing, first, the conveying roller 36 is normally rotated to convey the printing medium P in the normal direction. Accordingly, printing is performed on one surface (hereinafter referred to as a "surface" or a "first printing surface") of the printing medium P fed from the paper feeding section 2. Thereafter, the conveying roller 36 is rotated in the reverse direction to send the printing medium P on the paper feeding conveying route 94 to the inversion conveying route 93 where front and back of the printing medium P are inverted from each other. Specifically, the front and back sides of the printing medium P is inverted while passing through the inversion conveying route 93 in the order of A to F as shown in FIG. 3. Thereafter, the printing medium P having its front and back inverted is sent to the platen 34 again through the paper feeding conveying route 94. Subsequently, printing is performed on the other surface (hereinafter referred to as a "back surface" or a "second printing surface") of the printing medium by the printing head 7 based on the back side data to be described with reference to FIG. 8 and FIGS. 9A to 9G.

Note that a printing method of this embodiment is configured to always perform the double-sided printing, the printing method in which the reaction liquid is applied onto a back side of an image to be printed. Therefore, particularly when an image is printed only on one side, printing throughput is lowered. Thus, the printing apparatus may have a mechanism for automatically or manually switching to the printing method of this embodiment in the case of printing an image having a high image duty which causes curling. Specifically, in the case of printing an image having a low image duty, the image may be printed by use of a conventional printing method based on only image data to be printed. Thus, it is possible to prevent an extreme decline in the printing throughput. Moreover, the printing method may be switched by using a sensor or the like to detect the thickness of paper and by determining a probability of causing the curling. Specifically, it performs the printing method of this embodiment if the printing medium tends to curl, and it performs the printing method of the prior if the printing medium dos not tend to curl.

(G) Recording Head

Figure 4:
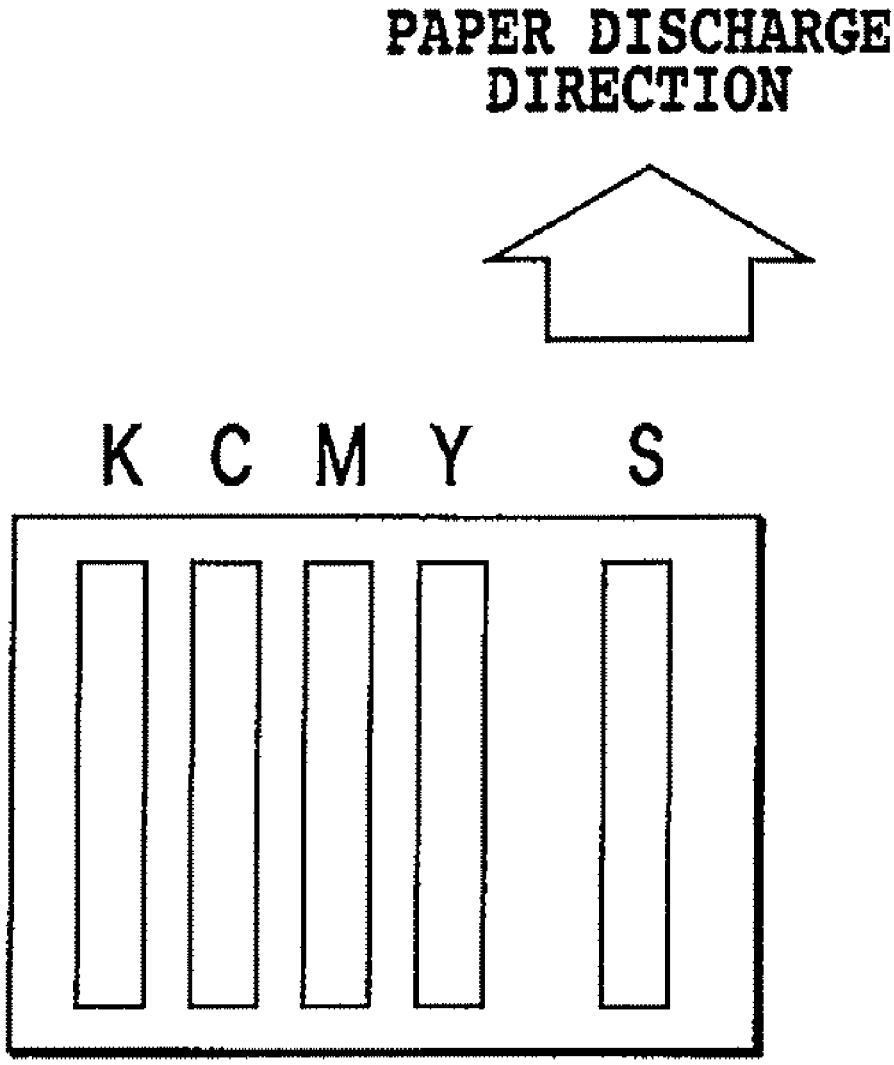
FIG. 4 is a structural drawing showing an ink jet printing head according to the first embodiment of the present invention.

FIG. 4 is a structural drawing showing the printing head according to the first embodiment of the present invention. Here, S denotes an ejection nozzle for a printing properties enhancing liquid (also called a "reaction liquid"). Moreover, C, M, Y and K denote ejection nozzles for inks of four colors, cyan, magenta, yellow and black. In this embodiment, the printing properties enhancing liquid is ejected before the inks when the ink jet head is scanned toward the right side in FIG. 4. On the other hand, the printing properties enhancing liquid is ejected after the inks when the ink jet printing head is scanned toward the left side.

Figure 5:
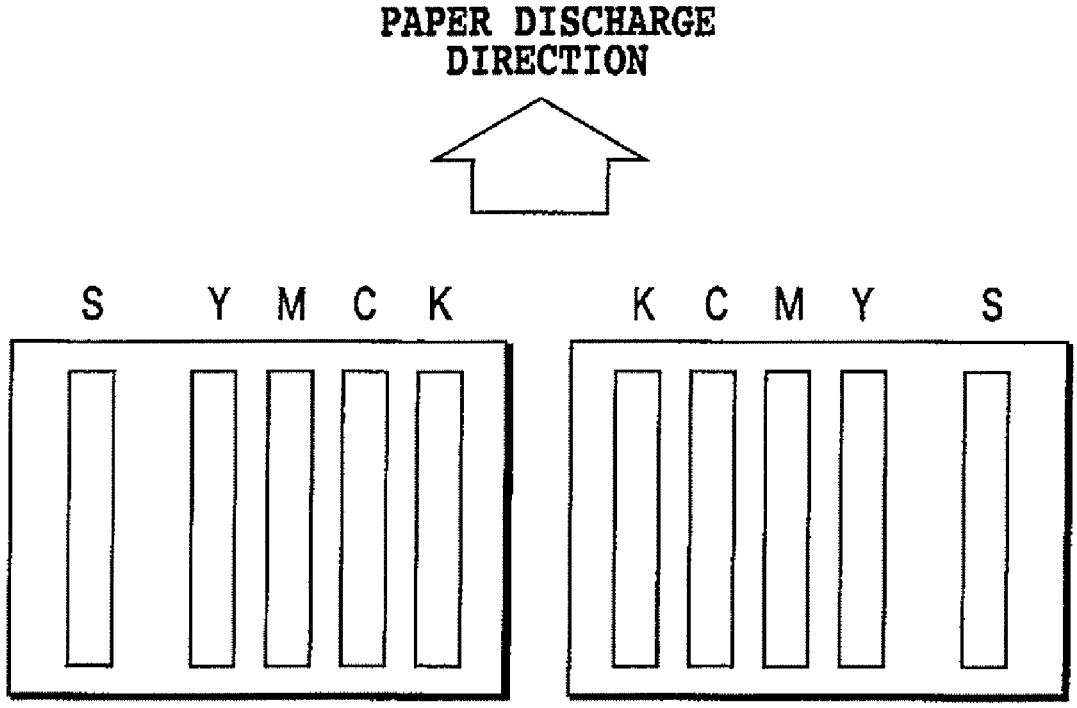
FIG. 5 is a structural drawing showing another ink jet printing head according to the first embodiment of the present invention.

FIG. 5 is a structural drawing showing another printing head according to the first embodiment of the present invention. This printing head is formed to have mirror-image arrangement. Accordingly, even if bi-directional printing is performed, the printing head enables high-speed printing which causes no color unevenness in both ways.

1.2 Overview of Recording System

Next, description will be given of a schematic configuration of a control system of the ink jet printing apparatus described above.

Figure 6:
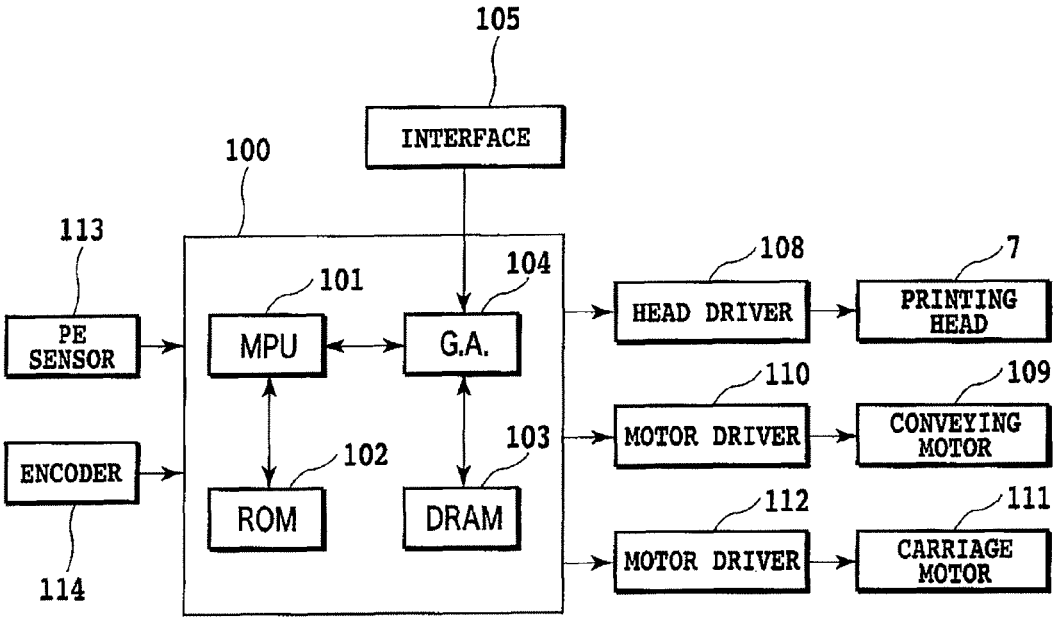
FIG. 6 is a block diagram schematically showing a configuration of a control system of the ink jet printing apparatus according to the first embodiment of the present invention.

FIG. 6 is a block diagram schematically showing the configuration of the control system of the ink jet printing apparatus according to the first embodiment of the present invention.

Reference numeral 100 denotes a controller which controls respective driving parts in the ink jet printing apparatus according to this embodiment. The controller 100 includes an MPU 101, a ROM 102, a DRAM 103 and a gate array (G. A.) 104. The MPU 101 executes various kinds of process, such as calculation, determination and control. The ROM 102 stores programs and the like to be executed by the MPU 101. The DRAM 103 temporarily stores inputted data and also functions as a work area for calculation process executed by the MPU 101.

Moreover, an interface 105 for transmitting and receiving a signal to and from an external apparatus such as a host computer is connected to the controller 100. A signal inputted to the interface is inputted to the MPU 101 and the DRAM 103 through the gate array 104. Furthermore, various drivers (108, 110 and 112) are connected to the controller 100. Among the drivers, a head driver 108 drives the heaters provided in each of the nozzles in the printing head 7. A motor driver 110 drives a conveying motor 109 for rotary driving the conveying roller 36 and the like. Furthermore, a motor driver 112 drives a carriage motor 111 for driving the carriage 50.

Furthermore, an encoder 114 for detecting a position of the carriage 50, a PE sensor 113 and the like are connected to the controller 100.

In the control system having the above configuration, when printing data is received from the host computer through the interface 105, the printing data is temporarily stored in the DRAM 103 via the gate array 104. Thereafter, the data in the DRAM 103 is converted by the gate array 104 from raster data to printing image data to be printed by the printing head 7, and the printing image data is stored in the DRAM 103 again. Then, the data is sent to the printing head 7 through the head driver 108, also by the gate array 104. Thereafter, heat is generated by driving the heaters at corresponding nozzle positions, and the inks are ejected by the heat energy to perform printing.

Figure 7:
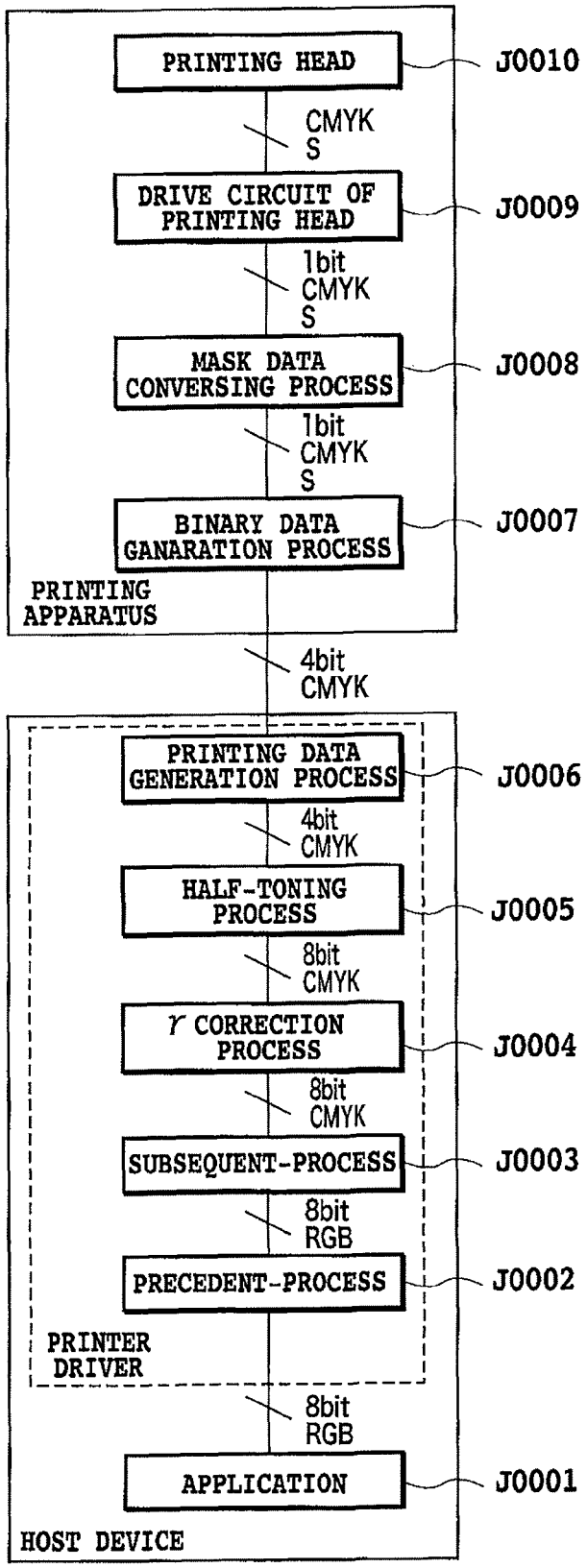
FIG. 7 is a block diagram showing a flow of image data in a printing system according to the first embodiment of the present invention.

FIG. 7 is a block diagram showing, along an image data flow, a printing system according to the first embodiment of the present invention. The printing apparatus of this embodiment performs printing by use of the inks of four colors, cyan, magenta, yellow and black, and the printing properties enhancing liquid. Therefore, the printing head which ejects the inks and the printing properties enhancing liquid is used.

Programs such as an application and a printer driver are operated by an operating system of a host apparatus 1000. An application J0001 executes process of generating image data to be printed by the printing apparatus. The image data or data before being edited or the like can be loaded onto a PC through various media. The PC in this embodiment can import, for example, JPEG format image data first taken by a digital camera through a CF card. Moreover, the PC can also import, for example, TIFF format image data read by a scanner or image data stored in a CD-ROM. Furthermore, the PC can import data on the Web via the Internet. The imported data is displayed on a monitor of the PC and edited, processed and so forth by the application J0001 to generate image data R, G and B of the sRGB Standard, for example. Thereafter, according to an instruction for printing, the image data is handed over to the printer driver.

For process to be executed by the printer driver of this embodiment, the printer driver has a precedent process J0002, a subsequent process J0003, a γ correction J0004, a halftoning J0005 and a printing data generation J0006. The precedent process J0002 performs mapping of a color gamut. The precedent process J0002 of this embodiment uses a three-dimensional LUT containing a relationship of mapping a color gamut reproduced by the image data R, G and B of the sRGB standard into a color gamut reproduced by the printing apparatus in the printing system of this embodiment. Moreover, while simultaneously executing interpolation calculation, the precedent process J0002 performs data conversion of converting the 8-bit image data R, G and B into data R, G and B within a color gamut of a printer. Based on the data R, G and B after the color gamut mapping is executed, the subsequent process J0003 performs process of obtaining color separation data Y, M, C and K corresponding to a combination of inks that reproduce colors expressed by the data, more specifically, yellow, magenta, cyan and black. In this embodiment, the above process is performed by using the three-dimensional LUT while simultaneously executing interpolation calculation, as in the case of the precedent process. The γ correction J0004 performs gradation value conversion for each of the data of the respective colors in the color separation data obtained by the subsequent process J0003. To be more specific, by use of a one-dimensional LUT corresponding to gradation characteristics of each of the color inks in the printing apparatus used in this system, the γ correction J0004 performs conversion so as to allow the color separation data to linearly correspond to gradation characteristics of the printer. The half-toning J0005 performs quantization for converting the 8-bit color separation data Y, M, C and K into 4-bit data, respectively. In this embodiment, the 8-bit data is converted into the 4-bit data by use of an error diffusion method. The 4-bit data is data to be an index for showing an arrangement pattern in binary data generation process in the printing apparatus. Lastly, the printing data generation J0006 generates printing data obtained by adding print control information to printing image data containing the 4-bit index data. Note that the application and the process of the printer driver described above are executed by a CPU according to programs thereof. In execution of the process, the programs are read from a ROM or a hard disk and used, and a RAM is used as a work area.

For data process, the printing apparatus performs binary data generation process J0007 and mask data conversion process J0008. In the binary data generation process J0007, for each of pixels corresponding to an actual printing image, dots are arranged according to a dot arrangement pattern corresponding to the 4-bit index data (gradation value information) that is the printing image data. As described above, for each of the pixels expressed by the 4-bit data, a dot arrangement pattern corresponding to the gradation value of the pixel is allocated. As a result, ON and OFF of dots are defined in each of a plurality of areas in the pixel. Moreover, ejection data of "1" or "0" is provided in each area within one pixel.

As described later, data for the printing properties enhancing liquid (hereinafter referred to as S data) is generated by use of Y, M, C and K data in the binary data generation process J0007. The following is an example of a method for generating the S data. First, Y, M, C and K data corresponding to each of front and back surfaces of the printing medium are stored in a memory. Thereafter, back surface data is read from the memory and is vertically and horizontally inverted (mirror-inverted) to obtain back surface inverted data. Lastly, S data for the front surface is generated by a logical sum of front surface data read from the memory and the back surface inverted data. Similarly, S data for the back surface is generated by a logical sum of the back surface data and front surface inverted data. Note that it is also possible to perform bold processing of allocating the printing properties enhancing liquid not only to positions corresponding to the Y, M, C and K data but also to positions adjacent thereto. The 1-bit ejection data Y, M, C, K and S thus obtained is subjected to mask processing by the mask data conversion process J0008. Specifically, in order to complete printing in a scanning region having a predetermined width by the printing head through a plurality of scans, ejection data for each scan is generated by processing using a mask corresponding to each of the scans. The ejection data Y, M, C, K and S for each scan is sent to a head drive circuit J0009 at proper timing. As a result, the printing head J0010 is driven to eject the respective inks in accordance with the ejection data. Note that the binary data generation process and the mask data conversion process described above in the printing apparatus are executed by use of a dedicated hardware circuit and under control of the CPU constituting the control section of the printing apparatus. Additionally, the processings described above may also be executed by the CPU in accordance with a program or may be executed by a printer driver, for example, in a PC.

2. Feature Configuration

Figure 8:
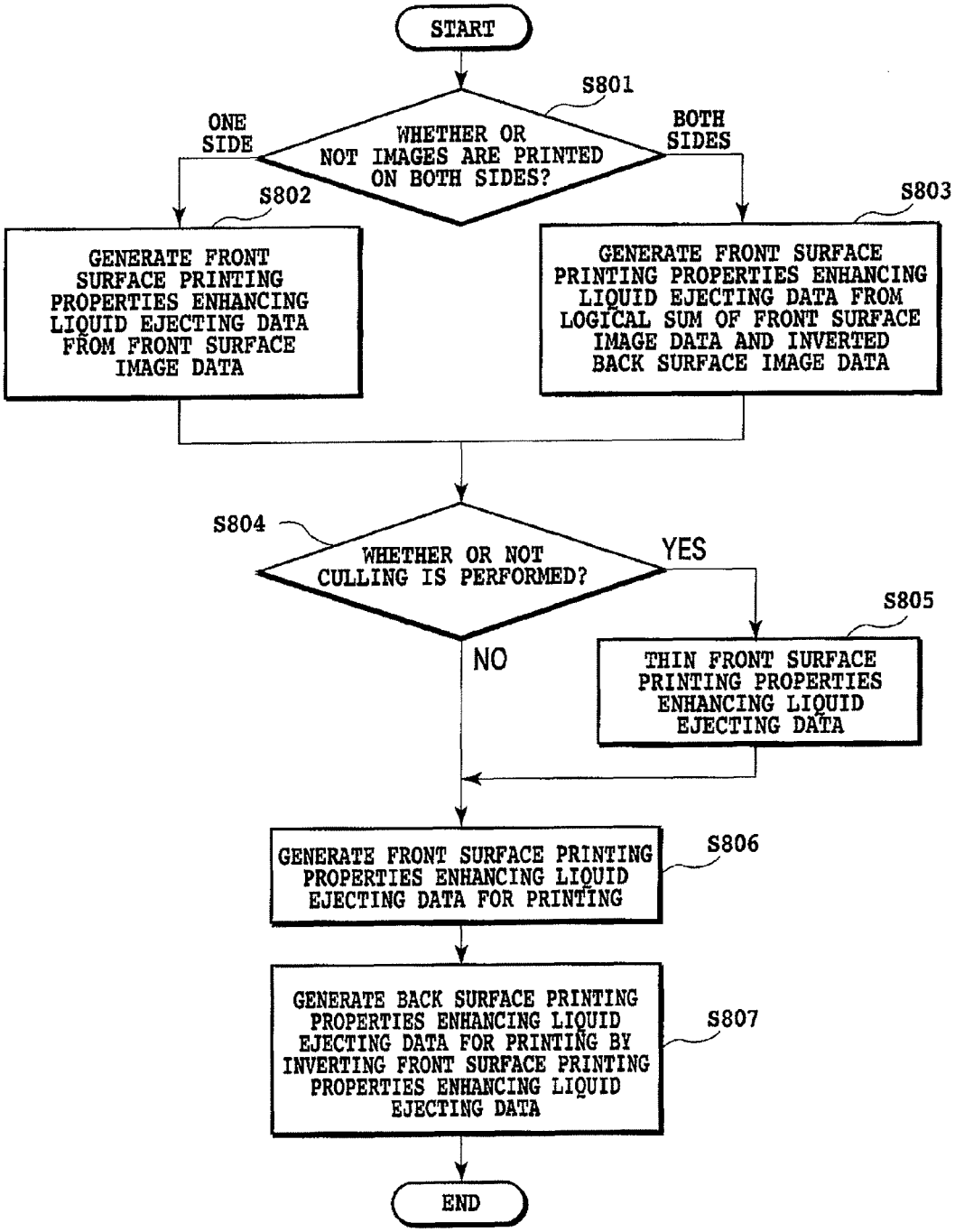
FIG. 8 is a flowchart showing generation of printing properties enhancing liquid ejecting data according to the first embodiment of the present invention.

FIG. 8 is a flowchart showing an example of a method for generating data for the printing properties enhancing liquid according to the first embodiment of the present invention.

In Step S801, it is determined whether or not to perform double-sided printing for printing on both of front and back surfaces of printing paper that is a printing medium. In the case of single-sided printing, printing properties enhancing liquid ejecting data (front surface reaction liquid ejection data) on the front surface is generated by use of front surface image data (front surface ink ejection data) (S802).

Moreover, in the case of the double-sided printing, the printing properties enhancing liquid ejecting data on the front surface is generated by use of the front surface image data and back surface inverted image data obtained by vertically and horizontally inverting back surface image data (S803). To be more specific, a logical sum of the front surface image data and the back surface inverted image data is obtained and set to be the printing properties enhancing liquid ejecting data on the front surface.

Next, in Step S804, it is determined whether or not to thin out the printing properties enhancing liquid ejecting data on the front surface obtained in Step S802 or S803. Here, whether or not to thin out the printing properties enhancing liquid ejecting data is determined based on the image data (ink ejecting data) or an instruction from a user. For example, the amount of the image data (number of the ink ejection dots denoted by ink ejection data) is detected. Thereafter, thin out process is determined not to be performed if the detected value is larger than a threshold, and is determined to be performed if the detected value is not more than the threshold. By executing the above process, a relatively large amount of the printing properties enhancing liquid can be applied to an image which has a large number of ink dots, and which is likely to suffer from ink bleed, and a relatively small amount of the printing properties enhancing liquid can be applied to an image which has a small number of ink dots, and which is not likely to suffer from ink bleed. Moreover, whether or not to perform the thin out process may also be determined by providing an operation unit in the host apparatus or the printing apparatus, to which the user can instruct whether or not to apply the printing properties enhancing liquid. Thereby, determination on whether or not to perform the thin out process can be made by detecting whether or not the instruction has been given by the user. Note that the present invention may not necessarily include the determination step in Step S804, and a configuration without the determination step may be adopted. In this case, it is possible to adopt any one of configurations where the thin out process is constantly executed, and where it is totally omitted.

In the case where the printing properties enhancing liquid ejecting data is to be thin out, the thin out process is performed in Step S805, and then front surface printing properties enhancing liquid ejecting data for printing is generated (S806). Meanwhile, in the case where the printing properties enhancing liquid ejecting data is not to be thin out, the process advances to Step S806 while skipping Step S805.

Next, in Step S807, based on the front surface printing properties enhancing liquid ejecting data for printing obtained in S806, back surface printing properties enhancing liquid ejecting data for printing is generated. To be more specific, by vertically and horizontally inverting the front surface printing properties enhancing liquid ejecting data for printing, the back surface printing properties enhancing liquid ejecting data for printing is generated (S807). However, the data generation process in S807 is not limited to the above. For example, in the case of a single-sided printing mode, the back surface printing properties enhancing liquid ejecting data for printing can also be generated by vertically and horizontally inverting the front surface image data obtained in S802. Moreover, in the case of a double-sided printing mode, the back surface printing properties enhancing liquid ejecting data for printing can also be generated by obtaining a logical sum of front surface inverted image data, which is obtained by vertically and horizontally inverting the front surface image data in S803, and unillustrated back surface image data.

Figure 9A:
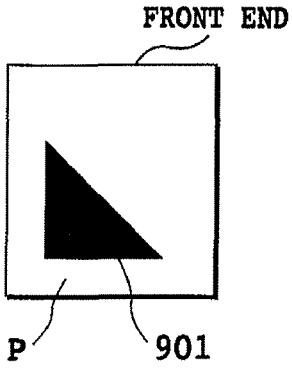
FIGS. 9A to 9G are views schematically showing the image data and the printing properties enhancing liquid ejecting data according to the first embodiment of the present invention.
Figure 9B:
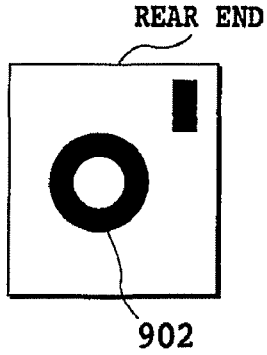
Figure 9C:
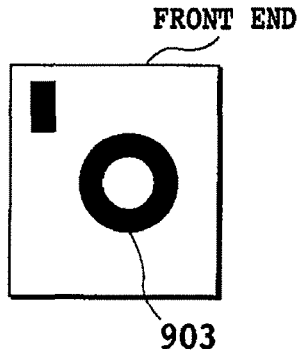
Figure 9D:
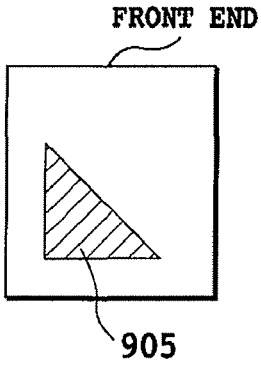
Figure 9E:
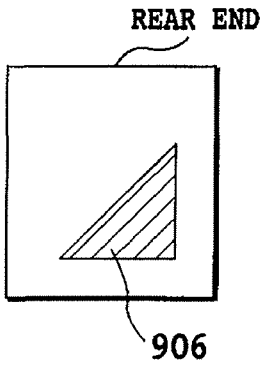

FIGS. 9A to 9G are views schematically showing the image data (ink ejecting data) and the printing properties enhancing liquid ejecting data (reaction liquid ejecting data). In FIGS. 9A to 9G, "front end" denotes an end on the downstream side in the direction of conveying the printing medium, and "back end" denotes an end on the upstream side in the direction of conveying the printing medium. FIG. 9A shows image data 901 printed with ink on the front surface of the printing medium P. When the single-sided printing is determined to be performed in Step S801, front surface printing properties enhancing liquid ejecting data 905 is formed in the same position as the front surface printing image data (front surface ink ejecting data) 901 (FIG. 9D). Thereafter, the process of thin out the printing properties enhancing liquid ejecting data (S805) is performed as needed, then front surface printing properties enhancing liquid ejecting data for printing is generated (S806). By vertically and horizontally inverting the front surface printing properties enhancing liquid ejecting data for printing, back surface printing properties enhancing liquid ejecting data for printing 906 is generated (FIG. 9E). As described above, the back surface printing properties enhancing liquid ejecting data for printing 906 is generated on the basis of the front surface printing properties enhancing liquid ejecting data for printing 905 obtained from the front surface printing image data. That is, the back surface printing properties enhancing liquid ejecting data for printing 906 is generated indirectly from the front surface image data (surface ink ejecting data) 901. Accordingly, when the ink image formed on one side (front surface), printing properties enhancing liquid ejecting data is formed in a back region corresponding to the spot where the ink image is formed on the one side. Note that, as described above, the back surface printing properties enhancing liquid ejecting data for printing 906 can also be generated by vertically and horizontally inverting the front surface image data. Accordingly, the back surface printing properties enhancing liquid ejecting data for printing 906 may be generated directly or indirectly from the front surface printing image data. In other words, the back surface printing properties enhancing liquid ejecting data for printing 906 may be generated on the basis of the front surface image data (front surface ink ejecting data) 901.

Figure 9F:
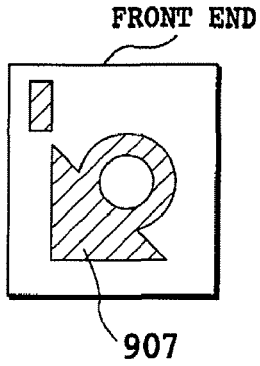
Figure 9G:
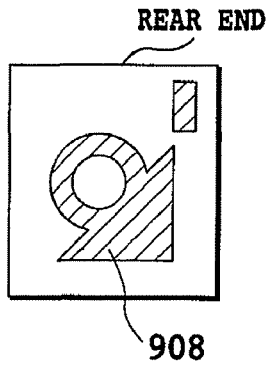

Meanwhile, when the double-sided printing is determined to be performed in Step S801, image data 902 printed with ink on the back surface of the printing medium P shown in FIG. 9B exists, in addition to the image data 901 shown in FIG. 9A. By vertically and horizontally inverting the back surface image data 902, back surface inverted image data 903 (FIG. 9C) is generated. Thereafter, from a logical sum of the front surface image data 901 and the back surface inverted image data 903, printing properties enhancing liquid ejecting data 907 to be printed on the front surface of the printing medium is generated (FIG. 9F). Accordingly, when the ink image formed on the other side (back surface), the printing properties enhancing liquid ejecting data is formed in a back region corresponding to the spot where the ink image is formed on the other side. Thereafter, the process of thin out the printing properties enhancing liquid ejecting data (S805) is performed as needed, then front surface printing properties enhancing liquid ejecting data for printing is generated. By vertically and horizontally inverting the front surface printing properties enhancing liquid ejecting data for printing, back surface printing properties enhancing liquid ejecting data for printing 908 is generated (FIG. 9G). Note, however, that the method for generating the back surface printing properties enhancing liquid ejecting data 908 is not limited to the above. For example, by obtaining a logical sum of front surface inverted image data (not shown), which is obtained by vertically and horizontally inverting the front surface image data 901, and the back surface image data 902, the back surface printing properties enhancing liquid ejecting data for printing 908 can also be generated. Either way, the back surface printing properties enhancing liquid ejecting data for printing 908 is generated based on at least the front surface printing image data 901.

The above process can prevent the printing medium from curling after printing and also prevent the curling when forming various images where individual image regions, image duties and the like differ from each other. Specifically, by utilizing characteristics of a two-in-one liquid system, the curling can be offset with a good balance according to the image region and the image duty.

Figure 10:
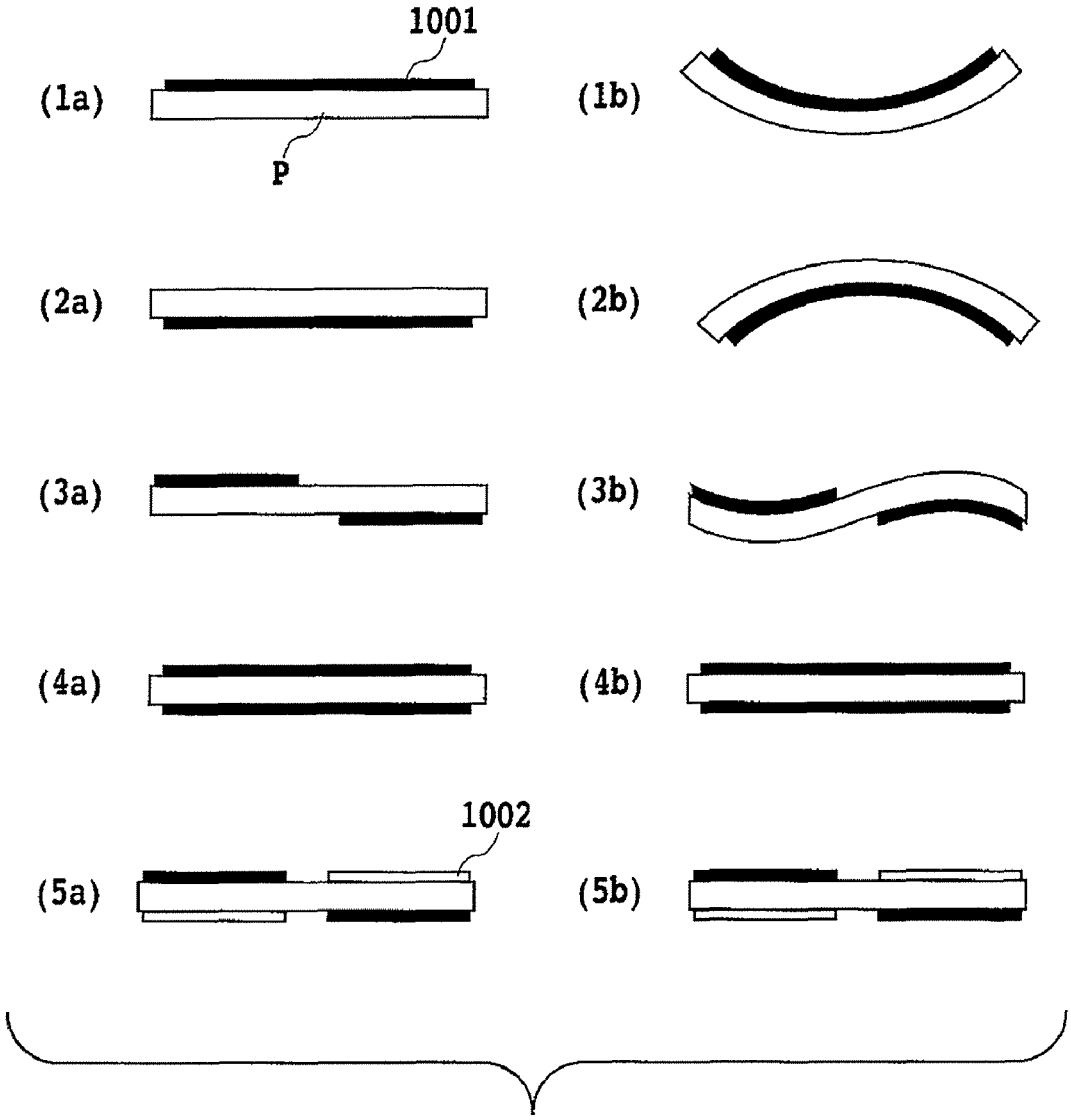
FIG. 10 is a schematic view showing a cross-section of a printing medium according to the first embodiment of the present invention.

FIG. 10 is a schematic view showing a cross-section of the printing medium. In general, it is considered that curling mainly occur due to adsorption and evaporation of water between fibers such as cellulose which forms the printing medium.

As shown in each of cases (1*a*) and (2*a*) of FIG. 10, when a water-based ink 1001 is applied to one side of the printing medium P, the printing medium P is normally curled over time with the printing surface on the inner side as shown in each of cases (1*b*) and (2*b*) of FIG. 10. The same can be said for the double-sided printing. When the ink is applied to different positions on each of the front and back surfaces as shown in a case (3*a*) of FIG. 10, the printing medium is curled into an S shape as shown in a case (3*b*) of FIG. 10. Meanwhile, when the ink is applied to the same position on the front and back surfaces as shown in a case (4*a*) of FIG. 10, curling hardly occur as shown in a case (4*b*) of FIG. 10. In the case (4*b*) of FIG. 10, it is conceivable that the curlings caused in the cases (1*b*) and (2*b*) of FIG. 10 offset each other. Therefore, by performing the process described above, a printing properties enhancing liquid 1002 is applied to each of the opposing surfaces of the positions of the ink 1001 applied to the printing medium P, as shown in a case (5*a*) of FIG. 10. Accordingly, a force of curling inward on the front surface is offset by that on the back surface. Thus, the curling can be suppressed as shown in a case (5*b*) of FIG. 10.

Note that, in the above description, adopted is the configuration in which the reaction liquid is ejected onto the entire region corresponding to the back side of the ink ejection position on one side of the printing medium. However, this embodiment is not limited to the above but may adopt a configuration in which the reaction liquid is ejected onto only a part of the region corresponding to the back side of the ink ejection position on the one side of the printing medium. To be brief, in this embodiment, it is only necessary to adopt a configuration in which the reaction liquid is ejected onto at least a part of the region corresponding to the back side of the ink ejection position on the one side of the printing medium.

3. Recording Properties Enhancing Liquid

Reaction Liquid 3.1 Recording Properties Enhancing Liquid 1

The printing properties enhancing liquid has a property of reacting with at least one component in at least one kind of ink to agglomerate or gelatinize the ink. For example, used is an ink having a color material stably dispersed or dissolved in an aqueous medium by action of an ionic group. In this case, it is preferable to use a printing properties enhancing liquid containing components which can destroy ink dispersion stability and agglomerate the ink when mixed with the ink on a printing medium or the like. To be more specific, cited is a printing properties enhancing liquid containing at least one of a polyvalent metal ion and salt thereof.

As the polyvalent metal ion that can be used for the printing properties enhancing liquid used in this embodiment, for example, a divalent metal ion such as $Ca^{2+}$, $Cu^{2+}$, $Ni^{2+}$, $Mg^{2+}$, $Zn^{2+}$ and $Ba^{2+}$, and a trivalent metal ion such as $Al^{3+}$, $Fe^{3+}$, $Cr^{3+}$ and $Y^{3+}$ are cited. However, the polyvalent metal ion to be used in this embodiment is not limited to those mentioned above. Moreover, the salt thereof means metallic salt made of the polyvalent metal ion as cited above and an anion binding thereto, and is required to be soluble in water. As the anion for forming the salt, for example, $C^{1-}$, $NO^{3-}$, $I^{-}$, $Br^{-}$, $ClO^{3-}$, $SO_4^{2-}$, $CO_3^{2-}$, $CH_3COO^{-}$, $HCOO^{-}$ and the like are cited. However, the anion is not limited to those mentioned above. Moreover, in consideration of effects related to this embodiment, it is preferable that a content of the salt in the printing properties enhancing liquid is 0.01 to 20 mass %, as polyvalent metal salt, relative to a total amount of the printing properties enhancing liquid.

In addition, it is preferable that the printing properties enhancing liquid to be used in the present invention is colorless. However, the printing properties enhancing liquid does not always have to be one that shows no absorption in a visible range. In other words, even if the printing properties enhancing liquid is one showing absorption in the visible range, a light-colored one showing absorption in the visible range may be used as long as there is virtually no influence on the image.

3.2 Recording Properties Enhancing Liquid 2

Another printing properties enhancing liquid according to this embodiment has a property of providing a printed product with light resistance, water resistance, fixability and density by forming a transparent top coat layer on a printing medium. For example, the printing properties enhancing liquid contains a polymer which has a carboxyl group and is made water-soluble by neutralization. To be more specific, a styrene-acrylic polymer solution is used, and, when the solution is ejected onto a printing medium after printing, a polymer film is generated on the surface of the printing medium. A polymer having carboxylate in a printing properties enhancing liquid may be stably dissolved therein. For example, it is preferable to use one obtained by solubilizing a vinyl copolymer by addition of a basic substance. Specifically, the vinyl copolymer is obtained by use of one or more kinds of acrylic acid monomers such as acrylic acid, meta-acrylic acid, maleic acid, half-ester of maleic acid and itaconic acid. As the basic substance in this event, which is not particularly limited, hydroxide of alkali metal, such as lithium hydroxide, sodium hydroxide and potassium hydroxide, ammonia water, monoethanolamine, diethanolamine, triethanolamine, monoisopropanolamine, diisopropanolamine, triisopropanolamine, morpholine, aminomethyl propanol, aminomethyl propanediol, aminoethyl propanediol and the like are cited. As a monomer that can be copolymerized with the acrylic acid monomer, although not particularly limited as long as the monomer can form a polymer having the target property, at least one kind of the following monomers, for example, can be used. Specifically, cited are: a (meth)acrylate monomer such as methyl (meth)acrylate, ethyl (meth)acrylate, isopropyl (meth)acrylate, n-butyl (meth)acrylate, isobutyl (meth) acrylate, n-amyl (meth)acrylate, isoamyl (meth)acrylate, n-hexyl (meth)acrylate, 2-ethylhexyl (meth)acrylate, n-octyl (meth)acrylate, decyl (meth)acrylate and dodecyl (meth) acrylate; a styrene monomer; benzyl (meth)acrylate; 2-antolyl (meth)acrylate; 2-(benzoyloxy)ethyl (meth)acrylate; 2-(5-ethyl-2-pyridyl)ethyl (meth)acrylate; [1,1-biphenyl]-4-yl (meth)acrylate; 7-oxo-1,3,5-cycloheptatriene-1-yl (meth) acrylate; 8-quinoryl (meth)acrylate; cyclohexyl (meth)acrylate; cyclododecyl (meth)acrylate; 1-methylhexyl (meth) acrylate; 1-methylheptyl (meth)acrylate; 2-methylpentyl (meth)acrylate; 1-cyclohexyl-3-azetidinyl (meth)acrylate; 9-carbazorylmethyl (meth)acrylate; tetrahydro-2H-pyran-2-yl (meth)acrylate; 3-nitrophenyl (meth)acrylate; 1-(3-perylenyl)ethyl (meth)acrylate; (3-methyloxyranyl)methyl (meth) acrylate; and the like. At least one kind selected from those mentioned above can be used.

Moreover, a content of the polymer having carboxylate in the printing properties enhancing liquid is preferably 1.0 to 15 wt %, more preferably, 1 to 6 wt % relative to the total amount of the printing properties enhancing liquid. When the content of the polymer in the printing properties enhancing liquid exceeds 15 wt %, viscosity of the printing properties enhancing liquid tends to be increased. For this reason, ejection stability in the ink jet printing method may not be obtained.

Moreover, another printing properties enhancing liquid according to this embodiment may contain resin emulsion. As a resin component in the resin emulsion, homopolymer or copolymer resin and the like are cited, such as vinyl acetate resin, acrylic resin, styrene resin and olefin resin.

As an aqueous medium used for the printing properties enhancing liquid used in this embodiment, for example, water or a mixture of water and a water-soluble organic solvent is cited. As the water-soluble organic solvent, one having an effect of reducing the printing properties enhancing liquid from drying is particularly preferable. To be more specific, alkyl alcohols having a carbon number of 1 to 4, such as methyl alcohol, ethyl alcohol, n-propyl alcohol, isopropyl alcohol, n-butyl alcohol, sec-butyl alcohol and tert-butyl alcohol; amides such as dimethylformamide and dimethylacetamide; ketone or keto-alcohols such as acetone and diacetone alcohol; ethers such as tetrahydrofuran and dioxane; polyalkylene glycols such as polyethylene glycol and polypropylene glycol; alkylene glycols including an alkylene group having 2 to 6 carbon atoms, such as ethylene glycol, propylene glycol, butylene glycol, triethylene glycol, 1,2,6-hexanetriol, thiodiglycol, hexylene glycol and diethylene glycol; lower alkyl ether acetate such as polyethylene glycol monomethyl ether acetate; glycerin; lower alkyl ethers of polyalcohols, such as ethylene glycol monomethyl (or ethyl) ether, diethylene glycol methyl (or ethyl)ether and triethylene glycol monomethyl (or ethyl) ether; polyalcohols such as trimethylolpropane and trimethylolethane; N-methyl-2-pyrrolidone, 2-pyrrolidone, and 1,3-dimethyl-2-imidazolidinone; and the like are cited. The water-soluble organic solvents as mentioned above can be used separately or as a mixture.

Moreover, deionized water is preferably used as water.

Although not particularly limited, a content of the water-soluble organic solvent in the printing properties enhancing liquid used in this embodiment is preferably 3 to 50 mass % relative to the total mass of the printing properties enhancing liquid. Moreover, a content of the water in the printing properties enhancing liquid is preferably 50 to 95 mass % relative to the total mass of the printing properties enhancing liquid. Furthermore, in addition to the above components, a surfactant, an antifoam, a preservative, a fungicide and the like can be added as needed, in order to allow the printing properties enhancing liquid to have a desired property value.

4. Ink

The printing properties enhancing liquid having the composition as described above is used in image formation together with at least one kind of ink. Moreover, the printing properties enhancing liquid reacts with the ink to agglomerate or gelatinize the ink. As the ink used in the image formation, particularly, ink having a color material dispersed or dissolved in an aqueous medium by an ionic group is used together with the printing properties enhancing liquid for printing. Accordingly, desired effects can be achieved, such as formation of a high-quality image in which curling is suppressed. As the color material that can be used for the ink, for example, a dye, a pigment (including a self-dispersion pigment and a microencapsulated pigment), precolored resin and the like are cited. In the present invention, it is preferable to use the pigment as the color material. The color material will be described in detail below.

4.1 Dye

As the dye used as the color material of the ink, heretofore known dyes can be used. For example, an acid dye, a direct dye, a disperse dye and the like can be used. For example, as an anionic dye, most anionic dyes such as existing ones and newly synthesized ones can be used as long as the dye has appropriate color tone and density. Moreover, a mixture of any of those described above can also be used. Specific examples of the anionic dye will be cited below.

(Color Material for Yellow)

C.I. Direct Yellow 8, 11, 12, 27, 28, 33, 39, 44, 50, 58, 85, 86, 87, 88, 89, 98, 100, 110, 132

C.I. Acid Yellow 1, 3, 7, 11, 17, 23, 25, 29, 36, 38, 40, 42, 44, 76, 98, 99

C.I. Reactive Yellow 2, 3, 17, 25, 37, 42

C.I. Food Yellow 3

(Color Material for Red)

C.I. Direct Red 2, 4, 9, 11, 20, 23, 24, 31, 39, 46, 62, 75, 79, 80, 83, 89, 95, 197, 201, 218, 220, 224, 225, 226, 227, 228, 229, 230

C.I. Acid Red 6, 8, 9, 13, 14, 18, 26, 27, 32, 35, 42, 51, 52, 80, 83, 87, 89, 92, 106, 114, 115, 133, 134, 145, 158, 198, 249, 265, 289

C.I. Reactive Red 7, 12, 13, 15, 17, 20, 23, 24, 31, 42, 45, 46, 59

C.I. Food Red 87, 92, 94

(Color Material for Blue)

C.I. Direct Blue 1, 15, 22, 25, 41, 76, 77, 80, 86, 90, 98, 106, 108, 120, 158, 163, 168, 199, 226

C.I. Acid Blue 1, 7, 9, 15, 22, 23, 25, 29, 40, 43, 59, 62, 74, 78, 80, 90, 100, 102, 104, 117, 127, 138, 158, 161

C.I. Reactive Blue 4, 5, 7, 13, 14, 15, 18, 19, 21, 26, 27, 29, 32, 38, 40, 44, 100

(Color Material for Black)

C.I. Direct Black 17, 19, 22, 31, 32, 51, 62, 71, 74, 112, 113, 154, 168, 195

C.I. Acid Black 2, 48, 51, 52, 110, 115, 156

C.I. Food Black 1, 2

4.2 Pigment

As the pigment, for example, carbon black, organic pigments and the like are cited.

(Carbon Black)

The carbon black is, for example, a carbon black pigment such as furnace black, lampblack, acetylene black and channel black. For example, Raven 7000, Raven 5750, Raven 5250, Raven 5000, Raven 3500, Raven 2000, Raven 1500, Raven 1250, Raven 1200, Raven 1190ULTRA-II, Raven 1170, and Raven 1255 (all of the above are manufactured by Columbia Corp.); Black Pearls L, Regal 400R, Regal 330R, Regal 660R, Mogul L, Monarch 700, Monarch 800, Monarch 880, Monarch 900, Monarch 1000, Monarch 1100, Monarch 1300, Monarch 1400, and Valcan XC-72R (all of the above are manufactured by Cabot Corp.); Color Black FW1, Color Black FW2, Color Black FW2V, Color Black FW18, Color Black FW200, Color Black S150, Color Black S160, Color Black S170, Printex 35, Printex U, Printex V, Printex 140U, Printex 140V, Special Black 6, Special Black 5, Special Black 4A, and Special Black 4 (all of the above are manufactured by Degussa Corp.); and No. 25, No. 33, No. 40, No. 47, No. 52, No. 900, No. 2300, MCF-88, MA600, MA7, MA8, and MA100 (all of the above are manufactured by Mitsubishi Chemical Corp.); and the like can be used. Note that the carbon black is not limited to those described above, and heretofore known carbon black can be used. Moreover, magnetic material fine particles, such as magnetite and ferrite, titanium black, or the like may also be used as a black pigment.

(Organic Pigment)

Specifically, examples of the organic pigment include: insoluble azo pigments such as toluidine red, toluidine maroon, hansa yellow, benzidine yellow and pyrazolone red; soluble azo pigments such as lithol red, helio bordeaux, pigment scarlet and permanent red 2B; derivatives from vat dyes such as alizarin, indanthrone and thioindigo maroon; phthalocyanine pigments such as phthalocyanine blue and phthalocyanine green; quinacridone pigments such as quinacridone red and quinacridone magenta; perylene pigments such as perylene red and perylene scarlet; isoindolinone pigments such as isoindolinone yellow and isoindolinone orange; imidazolone pigments such as benzimidazolone yellow, benzimidazolone orange and benzimidazolone red; pyranethrone pigments such as pyranethrone red and pyranethrone orange; indigo pigments; condensed azo pigments; thioindigo pigments; and other pigments such as fravanethrone yellow, acylamide yellow, quinophthalone yellow, nickel azo yellow, copper azo methine yellow, perynone orange, anthrone orange, dianthraquinonyl red and dioxazine violet.

Moreover, by using color index (C.I.) numbers, examples of the organic pigments include: C.I. Pigment Yellow 12, 13, 14, 17, 20, 24, 74, 83, 86, 93, 109, 110, 117, 120, 125, 128, 137, 138, 147, 148, 151, 153, 154, 166, 168; C.I. Pigment Orange 16, 36, 43, 51, 55, 59, 61; C.I. Pigment Red 9, 48, 49, 52, 53, 57, 97, 122, 123, 149, 168, 175, 176, 177, 180, 192, 215, 216, 217, 220, 223, 224, 226, 227, 228, 238, 240; C.I. Pigment Violet 19, 23, 29, 30, 37, 40, 50; C.I. Pigment Blue 15, 15:3, 15:1, 15:4, 15:6, 22, 60, 64; C.I. Pigment Green 7, 36; and C.I. Pigment Brown 23, 25, 26; and the like. As a matter of course, heretofore known organic pigments can be used besides those described above.

(Dispersant)

It is preferable to simultaneously use a dispersant when the carbon black and the organic pigments described above are used. As the dispersant, one that can stably disperse the above pigments in an aqueous medium by action of an anionic group is suitably used. Specific examples of the dispersant include, for example: styrene-acrylic acid copolymer; styrene-acrylic acid-acrylic acid alkyl ester copolymer; styrene-maleic acid copolymer; styrene-maleic acid-acrylic acid alkyl ester copolymer; styrene-methacrylic acid copolymer; styrene-methacrylic acid-acrylic acid alkyl ester copolymer; styrene-maleic acid half ester copolymer; vinyl naphthalene-acrylic acid copolymer; vinyl naphthalene-maleic acid copolymer; styrene-maleic anhydride-maleic acid half ester copolymer; salts thereof; and the like. Moreover, a weight-average molecular weight of the dispersants described above is preferably 1,000 to 30,000, more preferably, 3,000 to 15,000.

(Self-Dispersion Pigment)

As the color material, a pigment, so-called a self-dispersion pigment can also be used. The self-dispersion pigment can disperse itself in an aqueous medium without using the dispersant by allowing an ionic group (anionic group) to bind to a surface of the pigment. As an example of such a pigment, for example, self-dispersion carbon black can be cited. As the self-dispersion carbon black, for example, one having an anionic group binding to a surface of carbon black can be cited.

(Anionic CB)

As anionic carbon black, cited is one in which at least one anionic group selected from —COO(M2), —$SO_3$(M2), —$PO_3$H(M2) and —$PO_3(M2)_2$, for example, binds to a surface of carbon black.

In the above formulae, M2 represents a hydrogen atom, alkali metal, ammonium or organic ammonium. Among the above, carbon black anionically charged by —COO(M2) and —$SO_3$(M2) binding to a surface thereof can be particularly suitably used in this embodiment since the carbon black has good dispersibility in ink.

Meanwhile, among those represented by "M2" in the above-described hydrophilic groups, specific examples of the alkali metal include Li, Na, K, Rb, Cs and the like. Moreover, specific examples of the organic ammonium include methylammonium, dimethylammonium, trimethylammonium, ethylammonium, diethylammonium, triethylammonium, methanol ammonium, dimethanol ammonium, trimethanol ammonium and the like. Ink containing the self-dispersion carbon black, in which M2 is ammonium or organic ammonium, can further improve water resistance of printed images. In this point, the above self-dispersion carbon black can be particularly suitably used. This is considered to be attributable to the fact that, when the ink is applied onto a printing medium, ammonium is broken down to evaporate ammonia.

Here, the self-dispersion carbon black, in which M2 is ammonium, is prepared, for example, by use of a method for substituting ammonium for M2 by subjecting self-dispersion carbon black, in which M2 is alkali metal, to ion exchange. An alternative method may be to add acid to the self-dispersion carbon black to change M2 into H type and, thereafter, to add ammonium hydroxide to substitute ammonium for M2. As a method for preparing the anionically charged self-dispersion carbon black, cited is, for example, a method for subjecting carbon black to oxidation treatment with sodium hypochlorite. By this method, a —COONa group can be chemically bonded to the surface of the carbon black.

Meanwhile, such various hydrophilic groups as described above may be directly bonded to the surface of the carbon black. Alternatively, the hydrophilic groups may be indirectly bonded to the surface of the carbon black by interposing another atomic group between the surface of the carbon black and such a hydrophilic group. Specific examples of the atomic group include: linear or branched alkylene groups having 1 to 12 carbon atoms; a substituted or unsubstituted phenylene group; and a substituted or unsubstituted naphthylene group. Here, examples of substituent groups on the phenylene group and the naphthylene group include linear or branched alkyl groups having 1 to 6 carbon atoms. Specific examples of the combination of the atomic group and the hydrophilic group include —$C_2H_4$COO(M2), —Ph—$SO_3$(M2), —Ph—COO(M2) and the like (note that Ph is a phenyl group).

Meanwhile, in this embodiment, two or more kinds of self-dispersion carbon black may be suitably selected from those described above and be used as a color material for ink. The amount of the self-dispersion carbon black added into the ink is preferably 0.1 to 15 mass %, more preferably 1 to 10 mass % relative to the total mass of the ink. By controlling the amount of the self-dispersion carbon black within the above range, the self-dispersion carbon black can maintain a sufficiently dispersed state in the ink. Furthermore, a dye may be added as a color material in addition to the self-dispersion carbon black for the purpose of adjusting the color tone of the ink.

(Colored Fine Particles/Microencapsulated Pigment)

Other than those described above as the color material, pigments microencapsulated with polymers and the like, colored fine particles containing resin particles covered with a color material, or the like can also be used. Although the microcapsules essentially have dispersibility in an aqueous medium, the dispersant as described above may also be included in the ink for improving dispersion stability. In addition, when colored fine particles are used as a color material, the anionic dispersant described above or the like is preferably used.

4.3 Aqueous Medium

An aqueous medium that disperses the color material as described above is not particularly limited. The same media as those described above as the aqueous medium used in the printing properties enhancing liquid can be used. Moreover, when color inks are ejected to adhere to a printing medium by use of an ink jet method (for example, Bubble Jet® method or the like), adjustment is preferably made so as to achieve ink jet ejection characteristics and to allow the inks to have desired viscosity and surface tension. It is preferable that the aqueous medium to be used is prepared by appropriately selecting from the following and making adjustments thereto. In the printing method of this embodiment, when the printing properties enhancing liquid and the ink are separately applied for printing, it is preferable that the two curl in the same direction. For example, if the printing medium is curled inward with the printing properties enhancing liquid, it is preferable to select an aqueous medium such that the printing medium with the ink applied thereto is also curled inward.

As an aqueous medium used for the ink in this embodiment, for example, water or a mixture of water and a water-soluble organic solvent is cited. As the water-soluble organic solvent, one having an effect of reducing the ink from drying is particularly preferable. To be more specific, alkyl alcohols having a carbon number of 1 to 4, such as methyl alcohol, ethyl alcohol, n-propyl alcohol, isopropyl alcohol, n-butyl alcohol, sec-butyl alcohol and tert-butyl alcohol; amides such as dimethylformamide and dimethylacetamide; ketone or keto-alcohols such as acetone and diacetone alcohol; ethers such as tetrahydrofuran and dioxane; polyalkylene glycols such as polyethylene glycol and polypropylene glycol; alkylene glycols including an alkylene group having 2 to 6 carbon atoms, such as ethylene glycol, propylene glycol, butylene glycol, triethylene glycol, 1,2,6-hexanetriol, thiodiglycol, hexylene glycol and diethylene glycol; lower alkyl ether acetate such as polyethylene glycol monomethyl ether acetate; glycerin; lower alkyl ethers of polyalcohols, such as ethylene glycol monomethyl (or ethyl)ether, diethylene glycol methyl (or ethyl)ether and triethylene glycol monomethyl (or ethyl) ether; polyalcohols such as trimethylolpropane and trimethylolethane; N-methyl-2-pyrrolidone, 2-pyrrolidone, and 1,3-dimethyl-2-imidazolidinone; and the like are cited. The water-soluble organic solvents as described above can be used separately or as a mixture.

Moreover, deionized water is preferably used as water.

Although not particularly limited, a content of the water-soluble organic solvent in the ink used in this embodiment is preferably 3 to 50 mass % relative to the total mass of the ink. Moreover, a content of the water in the ink is preferably 50 to 95 mass % relative to the total mass of the ink. Furthermore, besides the above components, a surfactant, an antifoam, a preservative, a fungicide and the like as well as a humectant may be added as needed, in order to allow the ink to have a desired property value.

(Addition of Curling Inhibitor)

In the present invention, a significant effect is achieved without addition of the curling inhibitor cited in Patent Document 5. For the ink and/or the printing properties enhancing liquid, a material having an effect of reducing curling may be simultaneously used. Specific examples of such a material include: saccharides, more particularly, monosaccharides, oligosaccharides and sugar alcohols; 1,1,1-tris(hydroxylmethyl)propane; polyethylene glycol; hexanetriol; and the like. As a matter of course, the material is not limited to those compounds.

4.4 Ink Set

A color tone of an ink included in an ink set according to this embodiment in combination with the printing properties enhancing liquid described above is not particularly limited. For example, an ink showing one color tone selected from yellow, magenta, cyan, red, green, blue and black may be used. To be more specific, the color material can be appropriately selected from those described above and used so as to obtain an ink having a desired color tone. Here, the content of the color material in each ink may be appropriately selected so as to allow the ink to include excellent ink jet ejection characteristics and to have desired color tone and density in the case of use in ink jet printing, for example. As a standard, for example, the content of the color material is preferably 1 to 50 mass % relative to the total amount of the ink.

Moreover, the ink combined with the printing properties enhancing liquid is not limited to one kind. It is preferable to prepare an ink set suitable for forming multicolor images by combining two or more inks having different color tones. In this case, at least one of the two or more inks may react with the printing properties enhancing liquid.

If the ink to be used is one having a color material dispersed in an aqueous medium by action of an ionic group, other inks may be set to be ones containing dyes as color materials. As a matter of course, all the inks may be set to be ones having the color materials dispersed in the aqueous media by action of the ionic groups. Such an ink set enables suppression of bleeding when inks having different color tones are applied close to each other on a printing medium, which is seen as a common problem in forming multicolor images by use of an ink jet printing apparatus. To be more specific, bleeding seen as a problem in ink jet multicolor images tends to become noticeable particularly between a black ink and another color ink. The other color ink is at least one ink selected from, for example, a yellow ink, a magenta ink, a cyan ink, a red ink, a green ink and a blue ink. It is preferable also in this embodiment that the black ink is combined as the ink having the color material dispersed in the aqueous medium by action of the ionic group so as to interact with the printing properties enhancing liquid. Moreover, the other color inks may be set to be inks having dyes dissolved in aqueous media or, as a matter of course, may be set to be inks having color materials dispersed in aqueous media by action of ionic groups, as in the case of the black ink.

4.5 Ink Properties; Ink Jet Ejection Characteristics and Permeability into Recording Medium The ink set described above can be suitably used as an ink set for ink jet printing. As an ink jet printing method, there are: a printing method for applying mechanical energy to an ink to eject droplets; and a printing method for applying thermal energy to an ink to eject droplets by foaming of the ink. The printing properties enhancing liquid and the ink which are included in the ink set of this embodiment are particularly suitable for these printing methods. When the printing properties enhancing liquid and the ink according to the respective embodiments described above are used for ink jet printing, each of the printing properties enhancing liquid and the ink preferably has a property of enabling ejection thereof from an ink jet head. From the viewpoint of ejection property from the ink jet head, the liquid has the following properties. For example, viscosity thereof is preferably 1 to 15 cps, more preferably, 1 to 5 cps, and surface tension thereof is preferably 25 mN/m (dyne/cm) or more, more preferably, 25 to 50 mN/m (dyne/cm).

5. Examples

The embodiments of the present invention will be described in more detail below by use of examples and comparative examples. Note that "part" or "%" in the following description means part by mass or % by mass unless otherwise noted. First, pigment inks as color inks of black (K), cyan (C), magenta (M) and yellow (Y) each containing pigments and anionic compounds, are obtained as described below.

(Pigment Ink)

<Preparation of Pigment Dispersion>

| | |
|---|---|
| styrene-acrylic acid-ethyl acrylate copolymer (acid value 240, weight-average molecular weight = 5,000) | 1.5 parts |
| monoethanolamine | 1.0 part |
| diethylene glycol | 5.0 parts |
| ion-exchanged water | 81.5 parts |

The above components are mixed and heated to 70° C. using a water bath to completely dissolve resin content. In this solution, 10 parts of carbon black (MCF88 manufactured by Mitsubishi Kasei Corp.) that is newly trial-produced and 1 part of isopropyl alcohol are added. After pre-mixing is carried out for 30 minutes, dispersion process is executed under the following conditions.

Dispersion machine: Sand Grinder (manufactured by Igarashi Kikai Co.)

Grinding media: Zirconium beads of 1 mm in diameter

Packing of grinding media: 50% (volume ratio)

Grinding time: 3 hours

Furthermore, centrifugal separation (at 12,000 rpm for 20 minutes) is carried out to remove coarse particles. Thus, a pigment dispersion is obtained.

<Preparation of Pigment Ink K1>

The components having the following composition ratio are mixed using the above dispersion to prepare an ink containing a pigment to be a pigment ink. The surface tension of the pigment ink is 34 mN/m.

| | |
|---|---|
| above prepared pigment dispersion | 30.0 parts |
| glycerin | 10.0 parts |
| ethylene glycol | 5.0 parts |
| N-methylpyrrolidone | 5.0 parts |
| ethyl alcohol | 2.0 parts |
| Acetylenol EH (manufactured by Kawaken Fine Chemicals Co.) | 1.0 part |
| ion-exchanged water | 47.0 parts |

(Pigment Inks C1, M1 and Y1)

Pigment inks C1, M1 and Y1, each containing a pigment, are prepared in the same manner as in the preparation of the pigment ink K1 except that 10 parts of carbon black (MCF88 manufactured by Mitsubishi Kasei Corp.) used in the preparation of the pigment ink K1 is replaced by each of the pigments shown in Table 1 below.

TABLE 1

| | |
|---|---|
| Color Pigment Ink C1 | Pigment Blue 15 |
| Color Pigment Ink M1 | Pigment Red 7 |
| Color Pigment Ink Y1 | Pigment Yellow 74 |

<Preparation of Recording Properties Enhancing Liquid S1>

Next, after the following components are mixed and dissolved, the mixture is pressure-filtered through a membrane filter with a pore size of 0.22 μm (trade name: Fluoropore Filter manufactured by Sumitomo Electric Industries, Ltd.) to obtain a printing properties enhancing liquid S1.

| | |
|---|---|
| magnesium nitrate | 3.0 parts |
| diethylene glycol | 10.0 parts |
| methyl alcohol | 5.0 parts |
| Acetylenol EH (manufactured by Kawaken Fine Chemicals Co.) | 0.1 part |
| ion-exchanged water | 81.9 parts |

Example 1

As a printing apparatus capable of double-sided printing, an ink jet printer PIXUS 990i (manufactured by Canon Inc.) mounting an automatic double-side printing unit DPU-10 (manufactured by Canon Inc.) is used. As a printing material, the above prepared printing properties enhancing liquid 1, prepared black, yellow, magenta and cyan inks are used. In this printing apparatus, a pixel resolution is set to 600 dpi (vertical)×600 dpi (horizontal), and one pixel includes 2 (vertical)×4 (horizontal) areas. Therefore, a resolution in each area is set to 1200 dpi (vertical)×2400 dpi (horizontal). An amount of ejection by a printing head is 3 pl, and the printing head is configured to be able to eject ink droplets to each area having the resolution of 1200 dpi (vertical)×2400 dpi (horizontal) described above. By use of a A4 size plain paper Office Planner (manufactured by Canon Inc.), printing is performed on the entire surface of printing paper by such a printing apparatus. To be more specific, first, 4-pass bi-directional printing is performed on a surface of the plain paper by setting a printing duty for each of the colors K, C, M and Y in the ink arrangement shown in FIG. 4 to be 100% and by setting a printing duty of the printing properties enhancing liquid to be 100%. Next, the 4-pass bi-directional printing is performed on a back of the paper by setting the printing duty of the printing properties enhancing liquid to be 100%. Thus, a printed product for evaluating curling, which has a reaction liquid applied onto a back of an ink image, is prepared.

Meanwhile, on another sheet of the printing paper (plain paper), solid printing is performed while alternately using the black ink and the respective color inks by dividing a 10 cm square into 5×5 cells (the size of one cell: 2 cm×2 cm) and setting the printing duty of the printing properties enhancing liquid to be 100%. Next, 4-pass bi-directional printing is performed in a position corresponding to the front surface image on the back side of the paper by setting the printing duty of the printing properties enhancing liquid to be 100%. Thus, a printed product for evaluating bleeding is prepared.

Example 2

In Example 2, the same printing apparatus as that in Example 1 is used. Note, however, that printing conditions in Example 2 are different from those in Example 1 and are as follows. First, 4-pass bi-directional printing is performed on a surface of the plain paper by setting a printing duty for each of the colors K, C, M and Y in the ink arrangement shown in FIG. 4 to be 100% and by setting a printing duty of the printing properties enhancing liquid to be 50%. Next, the 4-pass bi-directional printing is performed on a back of the paper by setting the printing duty of the printing properties enhancing liquid to be 50%. Thus, a printed product for evaluating curling is prepared.

Moreover, on another sheet of the printing paper, solid printing is performed while alternately using the black ink and the respective color inks by dividing a 10 cm square into 5×5 cells (the size of one cell: 2 cm×2 cm) and setting the printing duty of the printing properties enhancing liquid to be 50%. Next, 4-pass bi-directional printing is performed in a position corresponding to the front surface image on the back side of the paper by setting the printing duty of the printing properties enhancing liquid to be 50%. Thus, a printed product for evaluating bleeding is prepared.

Comparative Example 1

In Comparative Example 1, the same printing apparatus as that in Example 1 is used. Note, however, that printing conditions in Comparative Example 1 are different from those in Example 1 and are as follows. 4-pass bi-directional printing is performed on a surface of the plain paper by setting the printing duty for each of the colors K, C, M and Y in the ink arrangement shown in FIG. 4 to be 100% and by setting the printing duty of the printing properties enhancing liquid to be 100%. However, no printing properties enhancing liquid is applied onto the back of the paper. Thus, a printed product for evaluating curling is prepared.

Moreover, on another sheet of the printing paper, solid printing is performed while alternately using the black ink and the respective color inks by dividing a 10 cm square into 5×5 cells (the size of one cell: 2 cm×2 cm) and setting the printing duty of the printing properties enhancing liquid to be 100%. Thus, a printed product for evaluating bleeding is prepared. Note that no reaction liquid is applied onto the back of the paper.

[Evaluation]

For the obtained images, occurrence of curling and bleeding are evaluated as described below. The following are methods and criteria for the evaluation. Table 2 shows evaluation results.

(Curling)

The printed products obtained in Examples 1 and 2 and Comparative Example 1 are left for one week in an environment of 30° C./15%. Thereafter, degrees of curling are visually observed and evaluated on the basis of the following criteria.

○: Curling hardly occurs.

Δ: Curling slightly occurs. (less than 1 cm of paper lifted height on a flat desk is set as a measure)

x: Curling occurs. (not less than 1 cm of paper lifted height on the flat desk is set as a measure)

(Bleeding)

Bleeding on a boundary between a black printing part and a color printing part in each of the printed products obtained in Examples 1 and 2 and Comparative Example 1 is visually observed and evaluated on the basis of the following criteria.

○: Boundary line between two colors is clear and no bleeding or color mixing is observed on the boundary.

x: Boundary line between two colors is not identifiable.

TABLE 2

| Evaluation Results |
|---|
| Example 1 |
| Example 2 |
| Comparative Example 1 |
| Curling |
| Bleeding |

Second Embodiment

1. Brief Description of Second Embodiment

In the first embodiment described above, it is determined whether or not to generate the printing properties enhancing liquid ejecting data for reducing curling based on the image data on the entire region of the printing medium. However, the present invention is not limited to such an embodiment. Specifically, it may be determined whether or not to generate printing properties enhancing liquid ejecting data for reducing curling based on the image data (ink ejecting data) for each unit region that divided a plurality of regions of an entire printing medium.

In the second embodiment, a printing medium is previously divided into a plurality of predetermined unit regions, and the number of ink ejections (the number of printing dots) indicated by ink ejection data corresponding to each of the unit regions is counted. Thereafter, when the number of printing dots ejected in each unit region is larger than a threshold, printing properties enhancing liquid ejection data for reducing curling on a back surface is created. Meanwhile, when the number of printing dots in each unit region is less than the threshold, the printing properties enhancing liquid ejection data for reducing and reducing curling on the back surface is not created. Such a configuration achieves effects of reducing deterioration in throughput and of reducing consumption of the printing properties enhancing liquid. Specifically, an ink image duty is rarely set uniform in the entire region of the printing medium, and the unit region having a high image duty and the unit region having a low image duty are mixed in many cases. For example, there is a case where a high image duty exists in an upper half and a low image duty exists in a lower half of A4 size plain paper. To be more precise, the high image duty is due to illustrations, the low image duty is due to description with characters. In this case, it is almost unnecessary to apply onto the entire back surface of the printing paper the printing properties enhancing liquid for reducing and reducing curling. Therefore, curling can be prevented by applying the printing properties enhancing liquid onto only the back of the upper half of the front surface where the unit region having the high image duty exists. Specifically, curling can be reduced to some extent without applying the printing properties enhancing liquid onto a back of the lower half of the front surface where the unit region having the low image duty exists. Applying the printing properties enhancing liquid onto the entire back surface of the printing paper despite the above fact may lead to deterioration of printing throughput or excessive consumption of the printing properties enhancing liquid. Therefore, in this embodiment, it is determined whether or not to create the printing properties enhancing liquid ejection data for reducing curling for each of the plurality of unit regions obtained by dividing the region on the printing medium. By determining whether or not to apply the printing properties enhancing liquid for each of the unit regions, excessive consumption of the printing properties enhancing liquid can be reduced. Moreover, in some cases, deterioration in the throughput can also be suppressed. Note that, in the present invention, the "unit regions" mean a plurality of regions obtained by dividing the region on the printing medium. Particularly, in this embodiment, regions 1202 obtained by dividing the region on the printing medium along a main scanning direction by a width in a sub-scanning direction of the printing head as shown in FIG. 12 are defined as the "unit regions."

2. Feature Configuration

Figure 11:
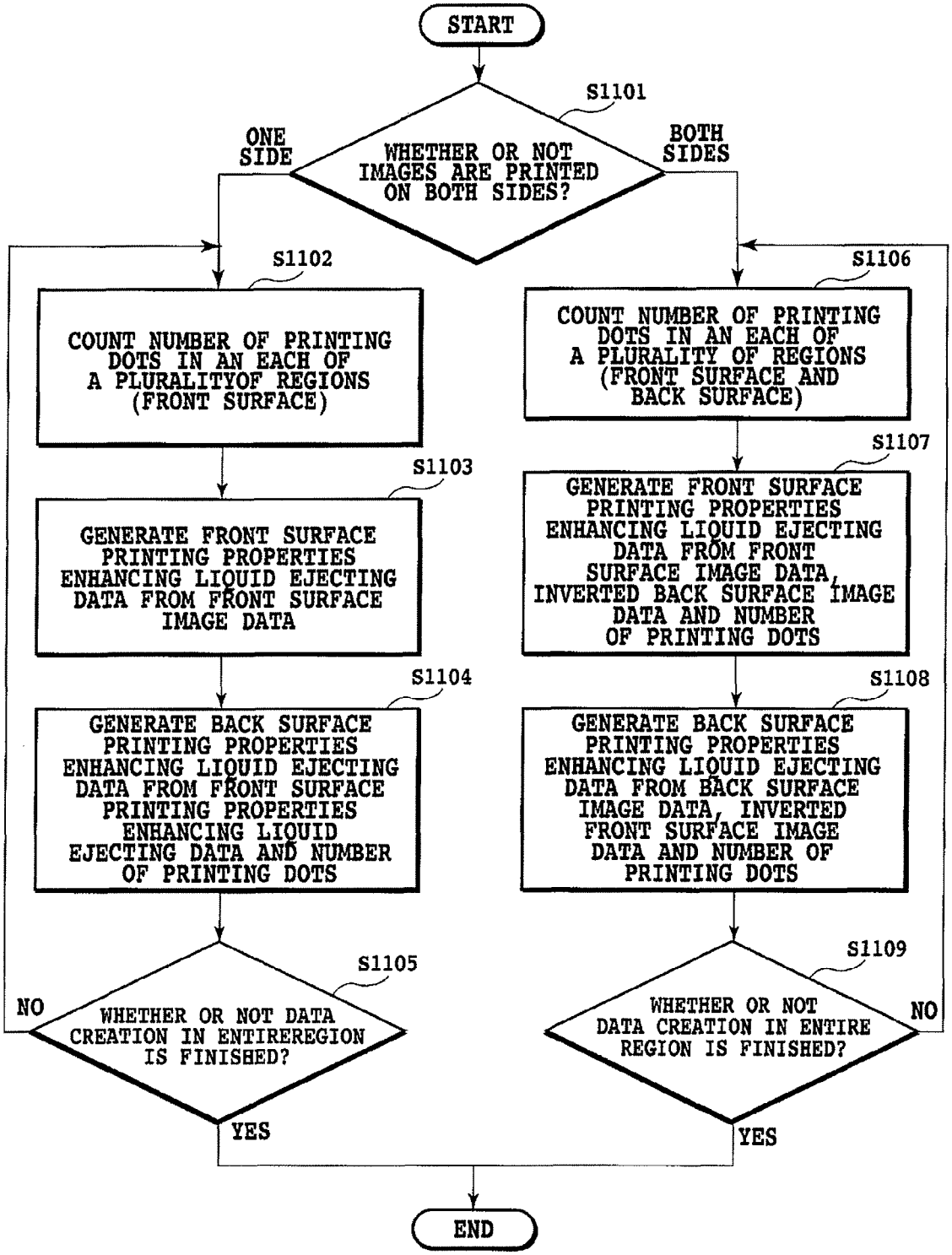
FIG. 11 is a flowchart showing generation of printing properties enhancing liquid ejecting data according to a second embodiment of the present invention.

FIG. 11 is a flowchart showing a method for generating the printing properties enhancing liquid data according to the second embodiment of the present invention.

In Step S1101, it is determined whether or not to perform double-sided printing for printing on both of front and back surfaces of the printing paper.

In the case of single-sided printing, one side of a printing medium is divided into a plurality of predetermined regions, and the number of ejections (the number of printing dots) of ejection data in each of the predetermined regions is counted and stored (S1102). Thereafter, by use of front surface image data, printing properties enhancing liquid ejecting data on the front surface is generated (S1103). Next, based on the printing properties enhancing liquid ejecting data on the front surface and the stored number of printing dots, printing properties enhancing liquid ejecting data for the back surface is generated (S1104). Note that, in this S1104, the printing properties enhancing liquid ejection data for the back surface may also be generated on the basis of the image data on the front surface and the stored number of printing dots. Subsequently, it is determined whether or not data creation in all the regions is finished (S1105). If the data creation is not finished, process for the next unit region is carried out. Moreover, if the data creation in all the unit regions is finished, the process of creating the printing properties enhancing liquid data is finished.

In the process for the single-sided printing, when the number of printing dots in each of the predetermined regions on the front surface is less than the predetermined number of dots (threshold), printing properties enhancing liquid ejection data on the back surface is generated so as not to eject the printing properties enhancing liquid onto the back surface of the printing medium. Meanwhile, when the number of printing dots is not less than the predetermined number of dots, the same process as that in the first embodiment is carried out.

Moreover, in the case of the double-sided printing, a printing medium is divided into a plurality of regions, and the number of ejections (the number of printing dots) of ink ejection data in each of the unit regions is counted and then stored on DRAM (S1106). This counting operation in step S1106 is performed on each of the front and back surfaces of the printing medium. Thereafter, printing properties enhancing liquid ejecting data on the front surface is generated on the basis of front surface image data, back surface inverted image data obtained by vertically and horizontally inverting back surface image data, and the stored number of ejections of the ink ejection data on the back surface (S1107).

In the process for the double-sided printing, when the number of printing dots in each of the predetermined regions on the back surface corresponding to the side opposite to the front surface is less than the predetermined number of dots (threshold), printing properties enhancing liquid ejection data is created on the basis of only the front surface image data. Meanwhile, when the number of printing dots in each of the predetermined regions on the back surface corresponding to the side opposite to the front surface is not less than the predetermined number of dots, printing properties enhancing liquid ejection data on the front surface is created on the basis of the front surface image data and the back surface inverted image data obtained by vertically and horizontally inverting the back surface image data, as in the case of the first embodiment.

Next, printing properties enhancing liquid ejecting data on the back surface is generated based on the back surface image data, front surface inverted image data obtained by vertically and horizontally inverting the front surface image data, and the stored number of printing dots on the front and back surfaces (S1108).

When the number of printing dots in each of the unit regions on the front surface corresponding to the side opposite to the back surface is less than the predetermined number of dots, printing properties enhancing liquid ejection data is created based on only the back surface image data. Meanwhile, when the number of printing dots in each of the unit regions on the back surface corresponding to the side opposite to the front surface is not less than the predetermined number of dots, printing properties enhancing liquid ejection data on the back surface is created based on the back surface image data and the front surface inverted image data obtained by vertically and horizontally inverting the front surface image data, as in the case of the first embodiment.

Subsequently, it is determined whether or not data creation in all the unit regions is finished (S1109). If the data creation is not finished, process for the next unit region is carried out. Moreover, if the data creation in all the regions is finished, the process of creating the printing properties enhancing liquid data is finished.

Note that, in this embodiment, the regions obtained by dividing the unit region on the printing medium along the main scanning direction by the width in the sub-scanning direction of the printing head are defined as the "unit regions". However, the form of the unit regions is not limited to the above. For example, a plurality of regions obtained by dividing the region on the printing medium along both of the main scanning and sub-scanning directions may be defined as the "unit regions".

Moreover, "the predetermined number of dots (threshold)" is a design value arbitrarily determined by a printer designer in consideration of the type of the printing medium, ink properties, the ejection amount, image resolution, maximum application amount per unit time for each unit region and frequency of occurrence of curling. Therefore, although a specific threshold value is not disclosed here, those skilled in the art will be able to easily determine what kind of a value is to be set as the threshold value.

Therefore, the predetermined number of dots on the front and back surfaces may be equivalent or may differ from each other.

Moreover, although not shown in FIG. 11, a step of thin out the printing properties enhancing liquid ejecting data can also be included as in the case of the first embodiment.

Figure 12A:
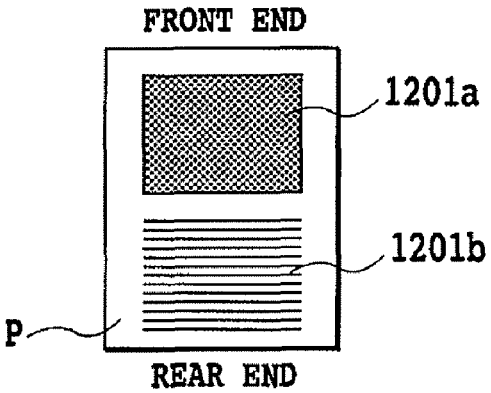
FIGS. 12A to 12D are views schematically showing image data and the printing properties enhancing liquid ejecting data according to the second embodiment of the present invention.
Figure 12B:
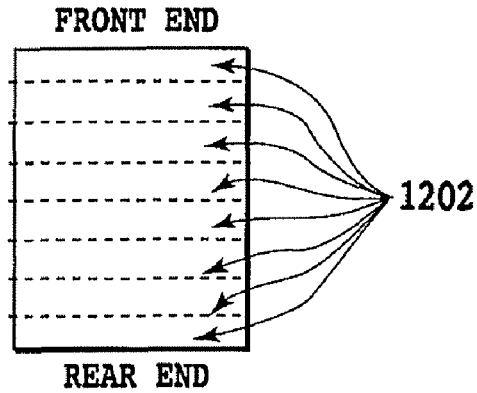

FIGS. 12A to 12D are views schematically showing the image data and the printing properties enhancing liquid ejecting data by taking the single-sided printing in the second embodiment as an example. In FIGS. 12A to 12D, "front end" denotes an end on the downstream side in the direction of conveying the printing medium, and "rear end" denotes an end on the upstream side in the direction of conveying the printing medium. FIG. 12A shows image data 1201*a* and 1201*b* printed with ink on the front surface of the printing medium P. In Step S1101, the single-sided printing is determined to be performed. Thereafter, in Step S1102, the printing medium is divided into a plurality of predetermined regions 1202 as shown in FIG. 12B, and the number of printing dots in each of the predetermined regions is stored.

Figure 12C:
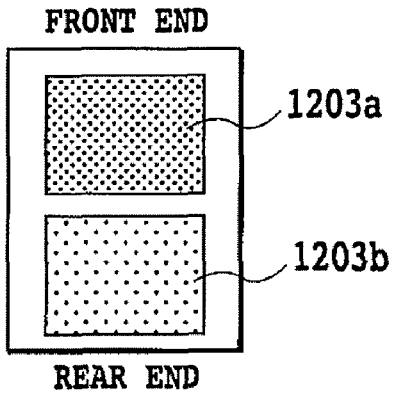

FIG. 12C shows printing properties enhancing liquid ejecting data 1203*a* and 1203*b* on the front surface, which are generated in Step S1103 on the basis of the image data 1201*a* and 1201*b*. Here, the front surface printing properties enhancing liquid ejecting data 1203*a* and 1203*b* exist in the same position as that of the front surface printing image data 1201*a* and 1201*b*.

Figure 12D:
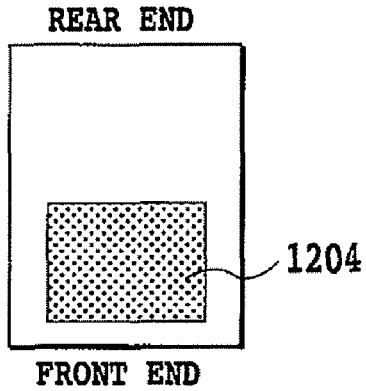

FIG. 12D shows back surface printing properties enhancing liquid ejection data for printing 1204 in a region corresponding to a back of the front surface image data 1201*a*. In an area where a high duty image exists, such as the front surface image data 1201*a*, it is determined that the number of printing dots Na in each of the unit regions 1202 is not less than the predetermined number of dots $N_0$. In this case, it is required to eject the printing properties enhancing liquid onto a region corresponding to the back of the front surface image data 1201*a*. Thus, the back surface printing properties enhancing liquid ejection data for printing 1204 to be printed on the back of the front surface image data 1201*a* is generated as shown in FIG. 12D (Step S1104). In this example, the back surface printing properties enhancing liquid ejection data for printing 1204 is generated in Step S1104 on the basis of the front surface printing properties enhancing liquid ejection data for printing 1203*a* and 1203*b* and the previously stored number of printing dots.

Note that, in Step S1104, the back surface printing properties enhancing liquid ejection data for printing 1204 may be generated on the basis of the front surface image data 1201*a* and 1201*b* and the previously stored number of printing dots. Meanwhile, in an area where a low duty image exists, such as the front surface image data 1201*b*, it is determined that the number of printing dots Nb in each of the unit regions 1202 is less than the predetermined number of dots $N_0$. In this case, the printing properties enhancing liquid is not ejected onto a region corresponding to a back of the front surface image data 1201*b*. Thus, back surface printing properties enhancing liquid ejection data for printing to be printed on the back of the front surface image data 1201*b* is not generated as shown in FIG. 12D.

As described above, the back surface printing properties enhancing liquid ejecting data for printing 1204 may be generated directly or indirectly from the front surface printing image data. Specifically, the back surface printing properties enhancing liquid ejecting data for printing 1204 may be generated on the basis of the front surface printing image data 1201*a* and 1201*b*.

Accordingly, in the image region 1201*a* having a high image duty, in which curling is likely to occur, curling is suppressed by applying the printing properties enhancing liquid to the opposing surface in accordance with the first embodiment. Meanwhile, since no printing properties enhancing liquid is applied to the opposing surface of the image region 1201*b* having a low image duty, in which curling is unlikely to occur, no printing operation is performed therein. Thus, deterioration of printing throughput is suppressed. Moreover, in this event, no printing properties enhancing liquid is applied to the opposing surface of the image region 1201*b*. Thus, an effect of suppressing consumption of the printing properties enhancing liquid can also be achieved.

2. Examples

Example 3

As a printing apparatus capable of double-sided printing, an ink jet printer PIXUS 990i (manufactured by Canon Inc.) mounting an automatic double-side printing unit DPU-10 (manufactured by Canon Inc.) is used. As printing materials, the above prepared printing properties enhancing liquid 1 and prepared black, yellow, magenta and cyan inks are used. In this printing apparatus, a pixel resolution is set to 600 dpi (vertical)×600 dpi (horizontal), and one pixel includes 2 (vertical)×4 (horizontal) areas. Therefore, a resolution in each area is set to 1200 dpi (vertical)×2400 dpi (horizontal). An amount of ejection by a printing head is 3 pl, and the printing head is configured to be able to eject ink droplets to each area having the resolution of 1200 dpi (vertical)×2400 dpi (horizontal) described above. By use of such a printing apparatus, printing is performed on printing paper. As the printing paper, an A4 size plain paper Office Planner (manufactured by Canon Inc.) is used. To be more specific, first, 4-pass bi-directional printing is performed in a region on an upper half of the printing paper by setting a printing duty for each of the colors K, C, M and Y in the ink arrangement shown in FIG. 4 to be 100% and by setting a printing duty of the printing properties enhancing liquid to be 100%. Subsequently, the 4-pass bi-directional printing is performed in a region on a lower half of the printing paper by setting the printing duty for each of the colors K, C, M and Y to be 5% and by setting the printing duty of the printing properties enhancing liquid to be 5%. Next, the 4-pass bi-directional printing is performed only in a region corresponding to a back of the region on the upper half of the printing paper by setting the printing duty of the printing properties enhancing liquid to be 100%. Thus, a printed product for evaluating curling is prepared.

Moreover, on another sheet of the printing paper, solid printing is performed while alternately using the black ink and the respective color inks by dividing a 10 cm square into 5×5 cells (the size of one cell: 2 cm×2 cm) and setting the printing duty of the printing properties enhancing liquid to be 100%. Next, 4-pass bi-directional printing is performed in a position corresponding to the front surface image on a back side of the paper by setting the printing duty of the printing properties enhancing liquid to be 100%. Thus, a printed product for evaluating bleeding is prepared. (Here, the predetermined number of dots $N_0$ is set to be the number of printing dots corresponding to the printing duty of 30%.)

Comparative Example 2

In Comparative Example 2, the same printing apparatus as that in Example 3 is used. Note, however, that printing conditions in Comparative Example 2 are different from those in Example 3 and are as follows.

4-pass bi-directional printing is performed in a region on an upper half of printing paper by setting the printing duty for each of the colors K, C, M and Y in the ink arrangement shown in FIG. 4 to be 100% and by setting the printing duty of the printing properties enhancing liquid to be 100%. Subsequently, the 4-pass bi-directional printing is performed in a region on a lower half of the printing paper by setting the printing duty for each of the colors K, C, M and Y to be 5% and by setting the printing duty of the printing properties enhancing liquid to be 5%. Thus, a printed product for evaluating curling is prepared. Note that, in Comparative Example 2, no printing properties enhancing liquid is applied onto the back of the paper.

Moreover, on another sheet of the printing paper, solid printing is performed while alternately using the black ink and the respective color inks by dividing a 10 cm square into 5×5 cells (the size of one cell: 2 cm×2 cm) and setting the printing duty of the printing properties enhancing liquid to be 100%. Thus, a printed product for evaluating bleeding is prepared.

[Evaluation]

The same evaluation as that in the first embodiment is performed. Table 3 shows evaluation results.

TABLE 3

| Evaluation Results | |
|---|---|
| Curling | Bleeding |
| Example 3 | |
| Comparative Example 2 | |

Other Embodiments

In the embodiments described above, the description has been given for a configuration of a so-called serial printer which performs printing by use of a printing head while moving a carriage in a main scanning direction perpendicular to a direction (sub-scanning direction) of conveying a printing medium P. However, the present invention is not limited to the serial printer. The present invention is also applicable to a so-called line printer which performs printing by ejecting inks from a printing head (also called a line head) having a length equivalent to a printing width of a printing medium P while conveying the printing medium P.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-165192, filed Jun. 14, 2006, and Japanese Patent Application No. 2007-101615, filed Apr. 9, 2007, which are hereby incorporated by reference herein in their entirety.

What is claimed is:

1. An ink jet printing apparatus which performs printing on a printing medium by ejecting from a printing head (1) an ink and (2) a reaction liquid which reacts with the ink, the apparatus comprising:

a reaction liquid ejection data generator that, on the basis of ink ejection data for ejecting the ink onto a first side of the printing medium, generates reaction liquid ejection data for ejecting the reaction liquid onto a second side opposite the first side of the printing medium; and a controller for printing by ejecting the ink onto the first side of the printing medium based on the ink ejection data and applying the reaction liquid onto the second side opposite the first side of the printing medium by ejecting the reaction liquid from a printing head based on the reaction liquid ejection data, wherein the reaction liquid ejection data generator inverts the ink ejection data to generate the reaction liquid ejection data for applying the reaction liquid onto a position of the second side which corresponds to a position of the first side on which ink is applied.

2. The ink jet printing apparatus according to claim 1, wherein the reaction liquid ejection data generator generates reaction liquid ejection data for ejecting the reaction liquid onto the first side of the printing medium on the basis of the ink ejection data for ejecting the ink onto the first side of the printing medium in addition to the reaction liquid ejecting data for ejecting the reaction liquid onto the second side opposite the first side of the printing medium.

3. The ink jet printing apparatus according to claim 2, wherein the reaction liquid ejection data generator generates reaction liquid ejection data for ejecting the reaction liquid onto the second side opposite the first side of the printing medium so that the reaction liquid would be ejected onto at least a part of the second side opposite the first side of a place in the printing medium on which the ink is ejected in accordance with the ink ejection data for ejecting the ink onto the first side of the printing medium.

4. The ink jet printing apparatus according to claim 2, further comprising a counter that counts the number of ink ejections indicated by the ink ejection data for each of a plurality of regions obtained by dividing the printing medium, wherein the reaction liquid ejection data generator generates reaction liquid ejection data for ejecting the reaction liquid onto the first side of the printing medium, and reaction liquid ejection data for ejecting the reaction liquid onto the second side opposite the first side thereof, on the basis of the counting results of the counter and ink ejection data for ejecting the ink onto the first side of the printing medium.

5. The ink jet printing apparatus according to claim 1, further comprising a counter that counts the number of ink ejections indicated by the ink ejection data for each of a plurality of regions obtained by dividing the printing medium, wherein the reaction liquid ejection data generator generates reaction liquid ejection data for ejecting the reaction liquid onto the second side opposite the first side of the printing medium, on the basis of the counting results of the counter and ink ejection data for ejecting the ink onto the first side of the printing medium.

6. An ink jet printing apparatus which performs printing on a printing medium by ejecting from a printing head (1) an ink and (2) a reaction liquid which reacts with the ink, the apparatus comprising:

a reaction liquid ejection data generator, wherein, in a case of double-sided printing, the reaction liquid ejection data generator generates reaction liquid ejection data for ejecting the reaction liquid onto a first side of the printing medium, on the basis of ink ejection data for ejecting the ink onto the first side of the printing medium and data obtained by inverting the ink ejection data for ejecting the ink onto the second side opposite the first side of the printing medium, and wherein, in the case of double-sided printing, the reaction liquid ejection data generator generates reaction liquid ejection data for ejecting the reaction liquid onto the second side opposite the first side of the printing medium, on the basis of data obtained by inverting the ink ejection data for ejecting the ink onto the first side of the printing medium and the ink ejection data for ejecting the ink onto the second side opposite the first side of the printing medium.

7. An ink jet printing apparatus which performs printing on a printing medium by ejecting from a printing head (1) an ink and (2) a reaction liquid which reacts with the ink, the apparatus comprising:

a reaction liquid ejection data generator, wherein, in a case of double-sided printing, the reaction liquid ejection data generator generates reaction liquid ejection data for ejecting the reaction liquid onto a first side of the printing medium, on the basis of ink ejection data for ejecting the ink onto the first side of the printing medium and data obtained by inverting ink ejection data for ejecting the ink onto the second side opposite the first side of the printing medium, and wherein, in the case of double-sided printing, the reaction liquid ejection data generator generates reaction liquid ejection data for ejecting the reaction liquid onto the second side opposite the first side of the printing medium, on the basis of the reaction liquid ejection data for ejecting the reaction liquid onto the first side of the printing medium.

8. A data generation apparatus which generates data to be used by an ink jet printing apparatus for performing printing on a printing medium by ejecting from a printing head (1) an ink and (2) a reaction liquid which reacts with the ink, the apparatus comprising:

a generator that, on the basis of ink ejection data for ejecting the ink onto the first side of the printing medium, generates reaction liquid ejection data for ejecting the reaction liquid onto a second side opposite the first side of the printing medium; and a controller for printing by ejecting the ink onto the first side of the printing medium based on the ink ejection data and applying the reaction liquid onto the second side opposite the first side of the printing medium by ejecting the reaction liquid from a printing head based on the reaction liquid ejection data, wherein the reaction liquid ejection data generator inverts the ink ejection data to generate the reaction liquid ejection data for applying the reaction liquid onto a position of the second side which corresponds to a position of the first side which ink is applying.

* * * * *